US012181197B2

(12) United States Patent
Lim et al.

(10) Patent No.: US 12,181,197 B2
(45) Date of Patent: Dec. 31, 2024

(54) REFRIGERATOR

(71) Applicant: SAMSUNG ELECTRONICS CO., LTD., Suwon-si (KR)

(72) Inventors: Hyeonkyu Lim, Suwon-si (KR); Juyeong Kim, Suwon-si (KR); Hyunuk Park, Suwon-si (KR); Daesung Ki, Suwon-si (KR); Chanyoung Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 217 days.

(21) Appl. No.: 17/993,012

(22) Filed: Nov. 23, 2022

(65) Prior Publication Data

US 2023/0251008 A1 Aug. 10, 2023

Related U.S. Application Data

(63) Continuation of application No. PCT/KR2022/017271, filed on Nov. 4, 2022.

(30) Foreign Application Priority Data

Feb. 7, 2022 (KR) ..... 10-2022-0015773

(51) Int. Cl.
*F25C 1/24* (2018.01)
*F25C 5/08* (2006.01)

(52) U.S. Cl.
CPC ..... *F25C 1/24* (2013.01); *F25C 5/08* (2013.01); *F25C 2400/06* (2013.01); *F25C 2400/10* (2013.01)

(58) Field of Classification Search
CPC .... F25C 1/24; F25C 2400/06; F25C 2305/00; F25C 2305/022; F25C 5/08; F25C 2400/10
See application file for complete search history.

(56) References Cited

U.S. PATENT DOCUMENTS 4,910,974 A 3/1990 Hara
9,234,688 B2 1/2016 Son et al.
(Continued)

FOREIGN PATENT DOCUMENTS

CN 209689245 U 11/2019
JP 3852609 B2 12/2006
(Continued)

OTHER PUBLICATIONS

International Search Report dated Feb. 10, 2023 in International Patent Application No. PCT/KR2022/017271 (5 pages; 5 pages English translation).
(Continued)

*Primary Examiner* — David J Teitelbaum
(74) *Attorney, Agent, or Firm* — STAAS & HALSEY LLP

(57) ABSTRACT

A refrigerator including an ice maker that includes a pressurizing member, a first tray including a first main ice-making cell and a first auxiliary ice-making cell. The ice maker includes a second tray coupleable to the first tray to form a spherical ice chamber, the second tray includes a second main ice-making cell coupleable to the first main ice-making cell to form a spherical ice chamber and a second auxiliary ice-making cell formed to extend upward from the second main ice-making cell and having a portion that contacts the first auxiliary ice-making cell, where, as the second tray is moved to separate the second main ice-making cell of the second tray coupled to the first main ice-making cell of the first tray that form the spherical ice chamber, the pressurizing member applies pressure to the second auxiliary ice-making cell of the second tray.

15 Claims, 23 Drawing Sheets

(56) References Cited

U.S. PATENT DOCUMENTS

| | | | | |
|---|---|---|---|---|
| 9,335,081 | B2 | 5/2016 | Son et al. | |
| 9,581,372 | B2 * | 2/2017 | Lee | F25C 5/08 |
| 10,697,684 | B2 * | 6/2020 | Bertolini | F25C 1/25 |
| 11,353,253 | B2 | 6/2022 | Kim et al. | |
| 11,953,252 | B2 | 4/2024 | Kim et al. | |
| 2013/0081412 | A1 * | 4/2013 | Son | F25C 5/04 62/340 |
| 2014/0165618 | A1 * | 6/2014 | Culley | F25C 1/18 62/71 |
| 2022/0003477 | A1 | 1/2022 | Lee et al. | |
| 2022/0260295 | A1 * | 8/2022 | Kim | F25C 5/06 |
| 2023/0258382 | A1 * | 8/2023 | Yao | F25C 1/24 62/340 |

FOREIGN PATENT DOCUMENTS

| | | |
|---|---|---|
| KR | 10-2013-0009332 | 1/2013 |
| KR | 10-2013-0110874 | 10/2013 |
| KR | 10-1850918 | 5/2018 |
| KR | 10-1890939 | 8/2018 |
| KR | 10-2020-0057559 | 5/2020 |
| KR | 10-2020-0058011 | 5/2020 |
| KR | 10-2021-0005778 | 1/2021 |
| KR | 10-2021-0031250 | 3/2021 |
| KR | 10-2021-0098201 | 8/2021 |

OTHER PUBLICATIONS

PCT/ISA/237 dated Feb. 10, 2023 in International Patent Application No. PCT/KR2022/017271 (4 pages).

* cited by examiner

REFRIGERATOR

CROSS-REFERENCE TO RELATED APPLICATION

This application is a continuation application, under 35 U.S.C. § 111(a), of International Patent Application No. PCT/KR2022/017271, filed on Nov. 4, 2022, which is based on and claims priority under 35 U.S.C. § 119 to Korean Patent Application No. 10-2022-0015773, filed on Feb. 7, 2022 in the Korean Intellectual Property Office, the disclosures of which are incorporated by reference herein in its their entirety.

BACKGROUND

1. Field

The disclosure relates to a refrigerator, and more particularly, to a refrigerator having an ice maker with an enhanced structure.

2. Description of the Related Art

In general, a refrigerator is a device that uses a cooling cycle with a compressor, a condenser, an expansion valve and an evaporator to refrigerate food. An ice maker for forming ice may be equipped in the refrigerator.

The ice maker may include an ice-making tray on which ice is formed, an ejector for separating the ice from the ice-making tray, and an ice bucket for storing the ice separated from the ice-making tray. The refrigerator may also include a controller for controlling the overall ice-making process to automatically form, separate and store the ice.

When too much water is supplied to the ice-making tray, an extra part of ice is formed in addition to the intended ice shape, lowering the degree of completion of the ice shape.

Furthermore, when ice of the extra part remains on the ice-making tray, there are difficulties in hygiene management and overall functions of the ice maker may be affected.

SUMMARY

According to an aspect of the disclosure, a refrigerator includes a storage chamber and an ice maker arranged in the storage chamber, wherein the ice maker includes a support frame, a pressurizing member arranged on an inner side of the support frame, a first tray coupleable to the support frame and including a first main ice-making cell and a first auxiliary ice-making cell formed to extend upward from the first main ice-making cell, and a second tray that is moveable, the second tray being coupleable to the support frame and coupleable to the first tray to form a spherical ice chamber, the second tray including a second main ice-making cell coupleable to the first main ice-making cell to form the spherical ice chamber, and a second auxiliary ice-making cell formed to extend upward from the second main ice-making cell and having a portion that contacts the first auxiliary ice-making cell, and wherein, as the second tray is moved to separate the second main ice-making cell of the second tray coupled to the first main ice-making cell of the first tray that form the spherical ice chamber, the pressurizing member applies pressure to the second auxiliary ice-making cell of the second tray.

The second auxiliary ice-making cell may include a projection formed to extend upward to interfere with the pressurizing member as the pressure is applied to the second auxiliary ice-making cell by the pressurizing member.

The refrigerator may further include a first case configured to receive the first tray, a first fixing member configured to cover at least one side among sides of the first tray to couple the first tray to the first case, the first fixing member being coupleable to the first case, a second case configured to receive the second tray, and a second fixing member configured to cover at least one side among sides of the second tray to couple the second tray to the second case, the second fixing member being coupleable to the second case.

The second auxiliary ice-making cell may further include a drain groove formed in the projection so that oversupplied water flows out of the second auxiliary ice-making cell.

The second fixing member may include a first drainage formed at an angle on a top surface for water drained along the drain groove to flow down, and the second case may include a second drainage formed at an angle on a top surface to be connected to the first drainage.

The second auxiliary ice-making cell may include an extension formed to extend toward the first auxiliary ice-making cell to be received in the first auxiliary ice-making cell.

The refrigerator may further include a water supply guide member mountable on the support frame and formed to extend between the first tray and the second tray to guide water supplied from a water supplier to the first main ice-making cell and the second main ice-making cell.

The first tray may include a first inlet formed to receive at least a portion of the water supply guide member to allow the water supplied by the water supplier to be introduced into the first main ice-making cell of the first tray, and the second tray may include a second inlet formed to receive at least other portions of the water supply guide member to allow the water supplied by the water supplier to be introduced into the second main ice-making cell of the second tray, and the second inlet facing the first inlet.

The first main ice-making cell is among a plurality of first main ice-making cells and the second main ice-making cell is among a plurality of second main ice-making cells, the first tray may include a first connecting portion formed to be sunken inward between the plurality of first main ice-making cells to allow the water introduced into the first main ice-making cell through the first inlet to flow to a neighboring first main ice-making cell, and the second tray may include a second connecting portion formed to be sunken inward between the plurality of second main ice-making cells to allow the water introduced into the second main ice-making cell through the second inlet to flow to a neighboring second main ice-making cell.

The second auxiliary ice-making cell may be connected to at least one of the plurality of second main ice-making cells and connected to the storage chamber.

The first auxiliary ice-making cell may include a first slope formed to extend upward at an angle increasing away from the second auxiliary ice-making cell, and the second auxiliary ice-making cell may include a second slope formed to extend upward at an angle increasing away from the first auxiliary ice-making cell.

The first slope may be formed is to extend at a lower angle than the second slope.

The refrigerator may further include a heater behind the first tray to heat the first tray before the second tray is moved.

The refrigerator may include a plurality of transfer gears configured to rotate by receiving power from a motor, each transfer gear among the plurality of transfer gears being arranged on either side of the support frame, and a rack gear interlocked with the plurality of transfer gears to be moved horizontally to move the second tray.

The pressurizing member may be configured to connect the plurality of transfer gears.

According to another aspect of the disclosure, a refrigerator includes a storage chamber, a support frame arranged in the storage chamber, a first tray including a first main ice-making cell coupleable to the support frame to form a first portion of ice, a second tray including a second main ice-making cell to engage with the first tray to form a remaining second portion of the ice and the second tray being moveable and coupleableto the support frame, a first auxiliary ice-making cell sunken from an inner surface of the first tray and formed to extend upward from the first main ice-making cell, a second auxiliary ice-making cell sunken from an inner surface of the second tray to face the first auxiliary ice-making cell and formed to extend upward from the second main ice-making cell, and a first fixing member coupleable to the first tray to cover sides of the first tray and including an auxiliary ice-making cell insert formed to extend to the inside of the first auxiliary ice-making cell.

The auxiliary ice-making cell insert may be formed to have higher thermal conductivity than thermal conductivity of the second auxiliary ice-making cell such that ice formed between the auxiliary ice-making cell insert and the second auxiliary ice-making cell is stuck to the auxiliary ice-making cell insert in response to the second tray being moved away from the first tray.

The auxiliary ice-making cell insert may include an extension formed to extend toward the second auxiliary ice-making cell to be received in the second auxiliary ice-making cell.

According to another aspect of the disclosure, a refrigerator includes a storage chamber and an ice maker arranged in the storage chamber, wherein the ice maker includes a support frame, a first tray arranged in the support frame, a second tray to form ice together with the first tray and arranged in the support frame to be movable to the first tray, a first main ice-making cell formed on the first tray, a first auxiliary ice-making cell connected to the first main ice-making cell of the first tray and formed to extend to the top of the first tray, a second main ice-making cell formed on the second tray at a position facing the first main ice-making cell, and a second auxiliary ice-making cell connected to the second main ice-making cell of the second tray at a position facing the first auxiliary ice-making cell and formed to extend upward, and including an extension received in the first auxiliary ice-making cell to have a wider area than the first auxiliary ice-making cell to come into contact with ice.

The refrigerator may further include a pressurizing member arranged on an inner side of the support frame to separate ice stuck to the second auxiliary ice-making cell from the second tray by applying pressure to an upper portion of the second auxiliary ice-making cell as the second tray is moved.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
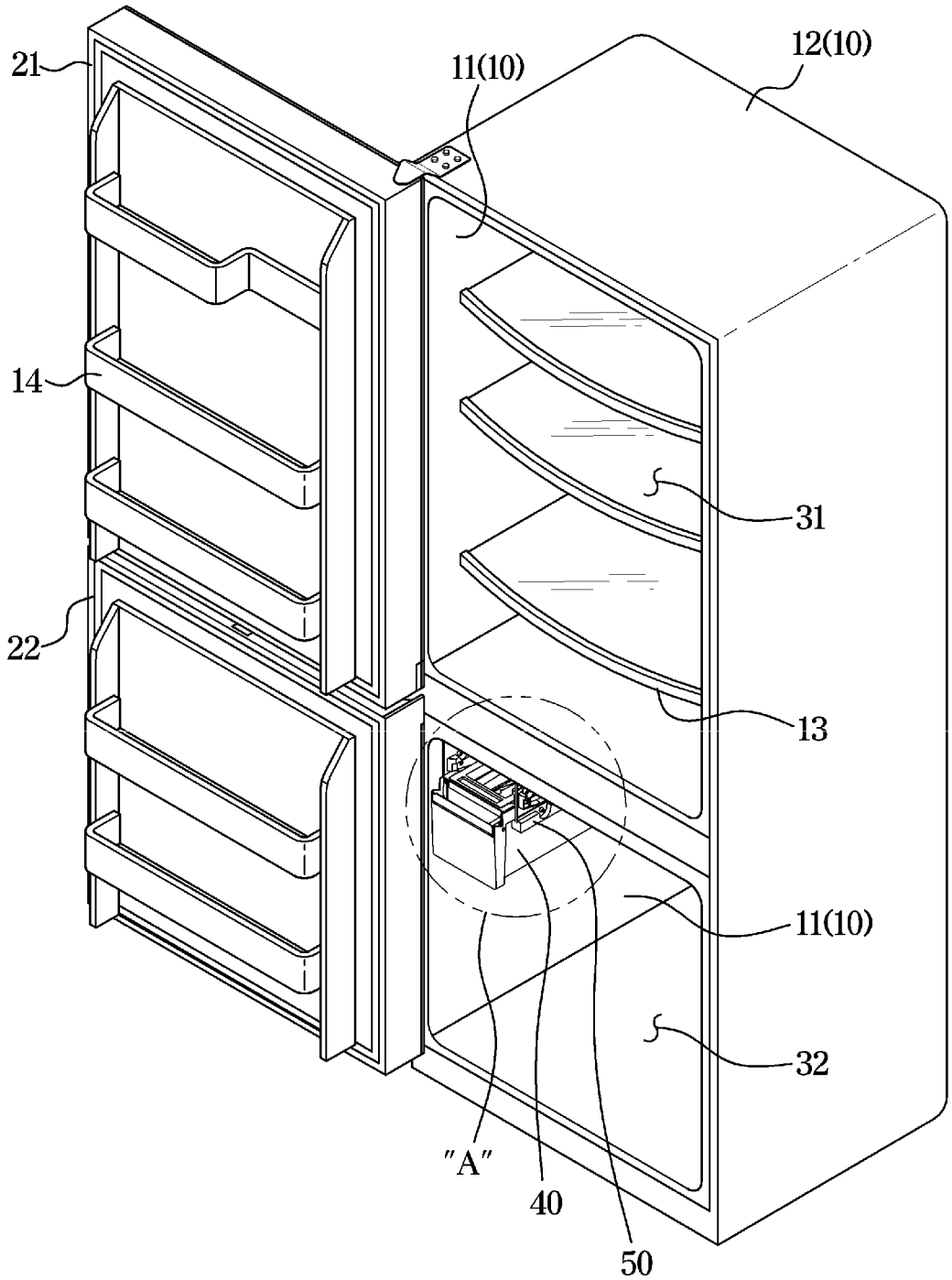
FIG. 1 is a perspective view of a refrigerator, according to an embodiment of the disclosure.

Embodiments and features as described and illustrated in the disclosure are merely examples, and there may be various modifications of the embodiments described in the text and shown in the drawings of this disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The disclosure provides a refrigerator having an ice maker with an enhanced structure to remove an unnecessary part of ice.

According to the disclosure, ice formed in the auxiliary ice-making cell is removed from ice formed in the main ice-making cell when the first tray is separated from the second tray, so the ice may give improved aesthetic feeling.

Furthermore, more hygienic ice may be formed because the ice separated from the main ice-making cell is not left on the tray.

Reference will now be made in detail to embodiments, examples of which are illustrated in the accompanying drawings, wherein like reference numerals refer to the like elements throughout.

Figure 2:
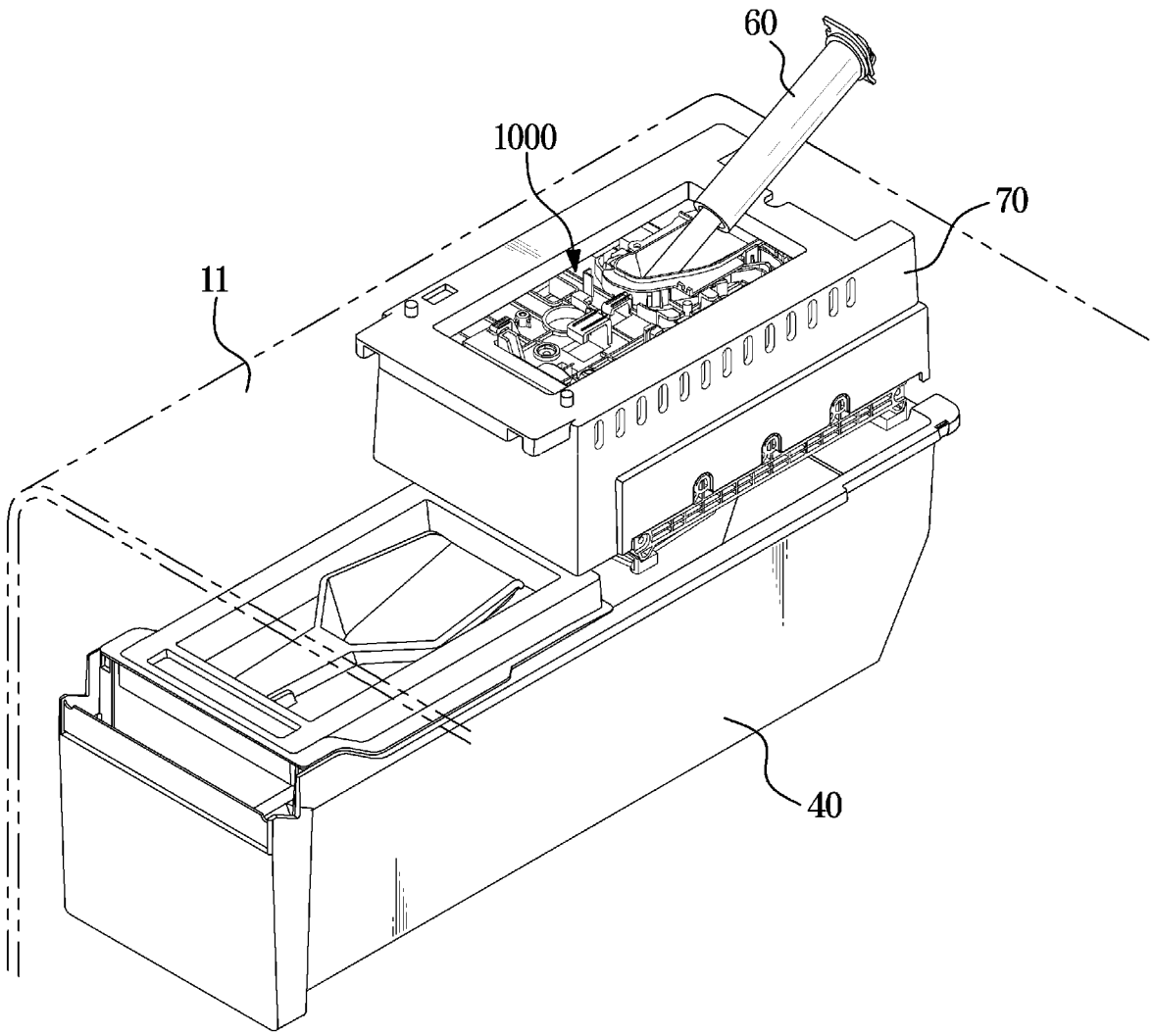
FIG. 2 is an enlarged perspective view of portion A of FIG. 1, according to an embodiment of the disclosure.

FIG. 1 is a perspective view of a refrigerator, according to an embodiment of the disclosure. FIG. 2 is an enlarged perspective view of portion A of FIG. 1.

Referring to FIGS. 1 and 2, a refrigerator 1 may include a main body 10, a storage chamber provided in the main body 10, and a door to open or close the storage chamber.

Although the refrigerator 1 is shown as a bottom mount fridge (BMF) refrigerator in the embodiment of the disclosure, the disclosure is not limited thereto and may be equally applied to various types of refrigerators such as a top mount freezer (TMF) type refrigerator, a French door refrigerator (FDR), a four-door refrigerator and a side by side (SBS) refrigerator.

The main body 10 may include an outer casing 12 and an inner casing 11.

Insulation (not shown) may be foamed between the outer casing 12 and the inner casing 11. The outer casing 12 may for an exterior of the refrigerator 1. The inner casing 11 may define the storage chamber. The inner casing 11 may be formed of a resin material.

The storage chamber may include a first storage chamber 31 and a second storage chamber 32. The first storage chamber 31 may be provided as a fridge, and the second storage chamber 32 may be provided as a freezer.

At least one shelf 13 may be mounted in the fridge to put foods or objects thereon. A storage container (not shown) may also be equipped in the fridge to store fresh foods.

The door may include a first door 21 and a second door 22. The first door 21 may be arranged to open or close the first storage chamber 31. The second door 22 may be arranged to open or close the second storage chamber 32.

The first door 21 may be rotationally coupled to the main body 10. The first door 21 may be arranged to open or close the open front of the first storage chamber 31. The first door 21 may be coupled to the main body 10 with hinges to pivot forward.

The second door 22 may be rotationally coupled to the main body 10. The second door 22 may be arranged to open or close the open front of the second storage chamber 32. The second door 22 may be coupled to the main body 10 with hinges to pivot forward.

Door guards 14 may be mounted on the inner surface of the first door 21 and the second door 22 to contain objects. There may be a plurality of door guards 14 on each door.

The refrigerator 1 may be cooled by a refrigeration cycle to maintain the first storage chamber 31 and the second storage chamber 32 at low temperature. Although not specifically shown, the refrigeration cycle may be set to supply cold air to the fridge and the freezer. The refrigeration cycle may be set with a compressor, a condenser, an evaporator, an expansion valve, etc., to produce cold air.

The refrigerator 1 may include a mounting frame 50. The mounting frame 50 may be coupled on one side of the inner casing 11 that forms the second storage chamber 32.

An ice maker 1000 provided to form ice by means of the cold air may be arranged on one side of the second storage chamber 32. An ice bucket 40 provided to store the ice formed by the ice maker 1000 may be mounted on the mounting frame 50 under the ice maker 1000.

In FIG. 2, arrangement of an ice-maker housing 70 and the ice bucket 40 in the second storage chamber 32 is shown with the mounting frame 50 omitted.

The ice maker 1000 may be received in the ice-maker housing 70. The ice-maker housing 70 may be mounted on the mounting frame 50. Accordingly, the ice-maker housing 70 and the ice bucket 40 may be mounted on the mounting frame 50 and fixed to the inside of the second storage chamber 32.

The refrigerator 1 may include a water supplier 60. The water supplier 60 may be provided to receive water from an external water supply source (not shown) to supply the water to the ice maker 1000.

The water supplier 60 may pass through the inner casing 11 of the refrigerator 1 to be communicated to the second store chamber 32. Hence, part of the water supplier 60 may be buried in the insulation and an end of the water supplier 60 is exposed to the second storage chamber 32 of the refrigerator 1. The other end of the water supplier 60 may be connected to the external water supply source.

Figure 3:
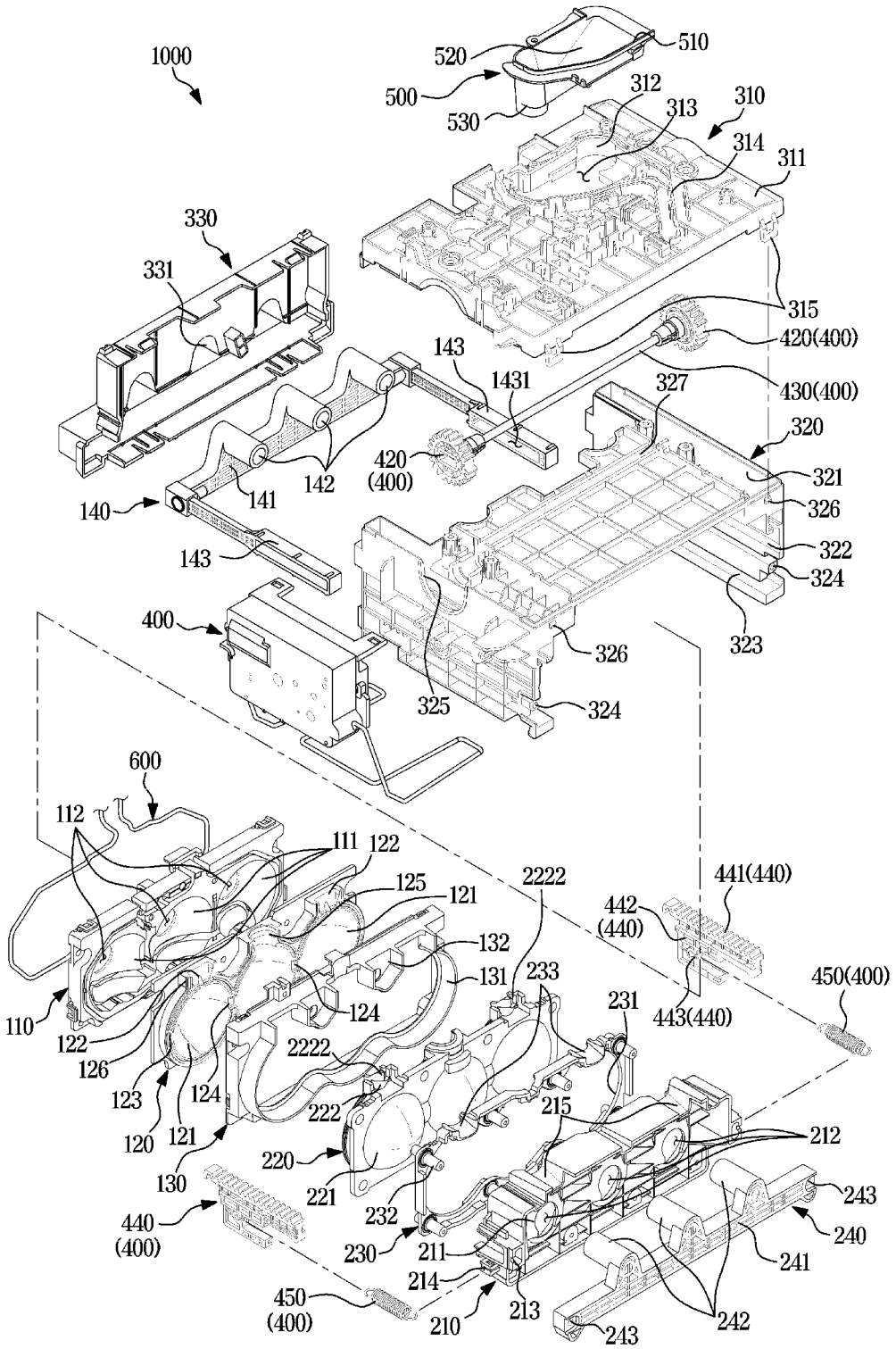
FIG. 3 is an exploded view of an ice maker of a refrigerator, according to an embodiment of the disclosure, according to an embodiment of the disclosure.

FIG. 3 is an exploded view of an ice maker of a refrigerator, according to an embodiment of the disclosure.

Referring to FIG. 3, the ice maker 1000 may include a support frame.

The support frame may be coupled with the ice-maker housing 70 (see FIG. 2) inside the ice-maker housing 70.

The support frame may include a first support frame 310 and a second support frame 320.

The first support frame 310 may be mounted on the top of the second support frame 320 to form the top surface of the support frame.

The first support frame 310 may include a first support body 311.

The first support body 311 may form an exterior of the first support frame 310. A guide mounting part 312 and a cut portion 313 may be arranged on the top surface of the first support body 311.

A water-supply guide member 500, which will be described below, may be mounted on the first support frame 310 by the guide mounting part 312. Furthermore, the water-supply guide member 500 may extend between a first tray 120 and a second tray 220, described herein, through the cut portion 313.

A heater receiver 314 may be arranged on the top surface of the first support body 311. A heater 600 may be received in the heater receiver 314 and fixed in a position.

A coupler 315 may be formed on a side of the first support body 311. The coupler 315 may extend from the side of the first support body 311 toward the second support frame 320. Relative positions of the first support frame 310 and the second support frame 320 may be fixed by the coupler 315.

The second support frame 320 may include a second support body 321.

The second support body 321 may form an exterior of the second support frame 320. The first support frame 310 may be arranged over the second support body 321 with space.

The second support frame 320 may be shaped substantially like a box with opposite two sides and bottom side open.

The second support body 321 may include a rack gear mounting part 322. The rack gear mounting part 322 may be formed on inner surface of either side extending downward from the top surface of the second support body 321. The rack gear mounting part 322 may be arranged to receive a rack gear 440, which will be described in more detail herein, to be movable in the horizontal direction relative to the second support frame 320.

The second support body 321 may include a leg supporter 323. The leg supporter 323 may be provided for legs 143 of a first ejector 140 to be settled therein. The leg supporter 323 may be formed under the rack gear mounting part 322. Specifically, the leg supporter 323 may be formed on the inner surface of either side extending downward from the top surface of the second support body 321.

The legs 143 of the first ejector 140 may be supported by the leg supporter 323 to be movable in the horizontal direction relative to the second support frame 320.

The second support body 321 may include an ejector mounting part 324. The ejector mounting part 324 may be formed on the rear surface of the second support body 321. The rear surface may be defined by defining a forward direction facing the first ejector 140 and a rearward direction facing a second ejector 240 based on the second support frame 320.

The second ejector 240 may be mounted in the ejector mounting part 324. Specifically, the second ejector 240 may be fixed to the support frame by an extra fastening member coupled to the frame mounting part 243 of the second ejector 240 and the ejector mounting part 324 of the second support frame 320.

The second support body 321 may include a transfer gear receiver 325.

The transfer gear receiver 325 may be formed on the top of either side extending downward from the top surface of the second support body 321.

A transfer gear 420 may be received in the transfer gear receiver 325 and may rotate by receiving power from a motor of a driver 400, and may be interlocked with the rack gear 440 received inside the second support frame to move the rack gear 440 in the horizontal direction. The transfer gear 420 may be provided in the plural to be received on either side of the second support body 321, and the rack gear 440 that interferes with the transfer gear 420 may also be provided in the plural to be received on either side of the second support body 321.

The rack gear 440 may be connected to a second case 210, which will be described in more detail herein, through an elastic member 450.

The rack gear 440 may include a toothed portion 441 arranged to be interlocked with the transfer gear 420. The rack gear 440 may include a support portion 442 to be supported by the support frame. The toothed portion 441 may be formed on top of the support portion 442.

The toothed portion 441 of the rack gear 440 and the transfer gear 420 are interlocked so that the rack gear 440 may be moved horizontally relative to the support frame.

The rack gear 440 may include a first elastic member mounting part 443 extending from the support portion 442. The elastic member 450 may be mounted in the first elastic member mounting part 443.

The transfer gear 420 and the rack gear 440 are arranged to be interlocked so that the rotational motion of the driver 400 may be transformed to the linear motion. Embodiments of the disclosure are not, however, limited thereto, and may be equally applied to any structure that may transform the rotational motion to the linear motion.

The elastic member 450 may be provided to connect the rack gear 440 to the second case 210.

Accordingly, as the rack gear 440 is moved horizontally by receiving the power generated by the driver 400 from the transfer gar 420, the second case 210 may also be moved horizontally relative to the support frame.

Specifically, the second case 210 has a structure that is combined and moved along with the second tray 220 and a second fixing member 230, which will be described herein, and with the movement of the second case 210, ice formed between the first tray 120 and the second tray 220 may be separated from the first tray 120 and the second tray 220.

Furthermore, as the rack gear 440 and the second case 210 are connected by the elastic member 450, while the first tray 120 and the second tray 220 are engaged by the movement of the second case 210 toward the first case 110, the rack gear 440 may be moved further forward, further increasing tightness between the first tray 120 and the second tray 220 due to the elastic force of the elastic member 450.

The transfer gear 420 may be provided in the plural to be arranged on either side of the support frame. The driver 400 may include a pressurizing member 430 arranged to connect the plurality of transfer gears 420. The pressurizing member 430 may be provided as a shaft that transfers the rotation of the transfer gear 420 on one side to the transfer gear 420 on the other side. The pressurizing member 430 may be shaped substantially like a bar extending long. The pressurizing member 430 is described in detail herein.

The second support body 321 may include a frame coupler 326. The frame coupler 326 may be arranged to mutually interfere with the coupler 315 formed on the first support body 311. The frame coupler 326 may have the form of a projection protruding from the rear surface of the second support body 321. With this, relative positions of the first support frame 310 and the second support frame 320 may be fixed.

The shapes of the coupler 315 of the first support frame 310 and the frame coupler 326 of the second support frame 320 are not limited thereto, and the coupler 315 of the first support frame 310 may have the shape of a projection and the frame coupler 326 of the second support frame 320 may have the form of a hook so that the coupler 315 and the frame coupler 326 may interfere with each other.

The second support body 321 may include a pressurizing member passing portion 327.

The pressurizing member passing portion 327 may be formed by cutting a portion of the top surface of the second support body 321. The pressurizing member 430 connecting the transfer gears 420 on both sides may be arranged farther down than the top surface of the second support body 321 through the pressurizing member passing portion 327. In other words, the pressurizing member 430 may pass the pressurizing member passing portion 327 and may be located inside the support frame.

The ice maker 1000 may include a cover frame 330.

The cover frame 330 may be arranged in front of the first support frame 310 and the second support frame 320. The cover frame 330 may be provided to cover an open side of the second support frame 320. The cover frame 330 may form one side of the support frame. It is not, however, limited thereto, and the cover frame 330 may be integrally formed with the support frame.

An ejector receiver 331 may be formed on the inner surface of the cover frame 330. The ejector receiver 331 may be sunken to the inside of the cover frame 330 to receive the first ejector 140.

The ice maker 1000 may include the water-supply guide member 500.

The water-supply guide member 500 may be provided to guide water supplied from the water supplier 60 (see FIG. 2) to the first main ice-making cell 121 and the second main ice-making cell 221, which is described herein. The water-supply guide member 500 may be mounted on the support frame and may extend between a first tray 120 and a second tray 220 to supply water.

The water-supply guide member 500 may include a guide body 510 mounted on the first support frame 310. A guide 520 may be formed on the inner surface of the guide body 510 to slope down.

The water-supply guide member 500 may include a supplier 530 extending downward from the guide body 510. The supplier 530 may be inserted between the first tray 120 and the second tray 220.

Accordingly, the water supplied from the supplier 60 may flow to the supplier 530 along the guide 520 of the water-supply guide member 500 and may be supplied between the first tray 120 and the second tray 220.

The ice maker 1000 may include the heater 600.

The heater 600 may be arranged behind the first tray 120. The heater 600 may be provided to heat the first tray 120 and a portion of the heater 600 may be supported by the first case 110. Furthermore, a portion of the heater 600 may be received in the heater receiver 314 of the first support frame 310.

The ice maker 1000 may include the first ejector 140 and the second ejector 240.

The first ejector 140 may be received in the ejector receiver 331 of the cover frame 330.

The first ejector 140 may include a first body 141, a first pressurizer 142, and the legs 143.

The first body 141 may extend in a direction parallel with the first case 110. In other words, the first body 141 may extend in a direction perpendicular to a direction of movement of the first ejector 140.

The first pressurizer 142 may extend from the first body 141. The first body 141 may be provided to support the first pressurizer 142.

The first pressurizer 142 may pass a first through hole 112 of the first case 110, which is described herein, to pressurize the first tray 120. Specifically, there may be a number of the first pressurizers 142 that correspond to the first main ice-making cells 121, so that each of the first pressurizers 142 may pressurize each of the first main ice-making cells 121.

The legs 143 may extend from both ends of the first body 141 and may be inserted to the sides of the support frame. More specifically, the leg 143 of the first ejector 140 may be supported by the leg supporter 323. The legs 143 may extend in a direction of movement of the first ejector 140. The legs 143 may be arranged on both ends of the first body 141 as a symmetrical pair.

Furthermore, the legs 143 may be provided to receive the projection 214 of the second case, which described herein. A projection receiving space 1431 may be formed on the inside of the leg 143. The projection 214 of the second case 210 may be received in the projection receiving space 1431 of the leg 143 to interfere with the leg 143.

The second ejector 240 may include a second body 241, a second pressurizer 242, and the frame mounting part 243.

The second body 241 may extend in a direction parallel with the second case 210. In other words, the second body 241 may extend in a direction perpendicular to a direction of movement of the second case 210. The second body 241 may extend to connect both sides of the second support frame 320.

The second pressurizer 242 may extend from the second body 241. The second body 241 may be provided to support the second pressurizer 242.

The second pressurizer 242 may pass a second through hole 212 of the second case 210 to pressurize the second tray 220. Specifically, there may be a number of the second pressurizers 242 that correspond to the second main ice-making cells 221, so that each of the second pressurizers 242 may pressurize each of the second main ice-making cells 221.

The frame mounting part 243 may be arranged at a position corresponding to the ejector mounting part 324 of the second support frame 320. The frame mounting part 243 may be formed on either end of the second body 241. The second ejector 240 may be mounted on one side of the second support body 321 through the frame mounting part 243. In other words, the second ejector 240 may be coupled and fixed to the second support frame 320.

The ice maker 1000 may include the first case 110, the first tray 120 and the first fixing member 130.

The first case 110 may include a first tray receiver 111. The first tray receiver 111 may be provided to receive a portion of the first main ice-making cell 121 of the first tray 120. There may be three first tray receivers 111 corresponding to the number of first main ice-making cells 121.

The first case 110 may include the first through hole 112. The first through hole 112 may be formed by being cut in the center of the first tray receiver 111. The first through hole 112 may be arranged for the pressurizer of the first ejector 140 to pass through.

The first tray 120 may include the first main ice-making cell 121. The first tray 120 may be fixed to the support frame. The first main ice-making cell 121 may be provided to form a first portion of ice. Specifically, the first main ice-making cell 121 may be provided to form a left portion of the ice. The first main ice-making cell 121 may be formed by being sunken inward from the inner surface of the first tray 120. The first main ice-making cell 121 may include a plurality of ice-making cells, each ice-making cell having a hemispherical shape or a similar shape. The inside of the first main ice-making cell 121 may be made up of spheres or a plurality of polygons (polyhedrons).

The first tray 120 may include the first auxiliary ice-making cell 122. The first auxiliary ice-making cell 122 may be sunken inward from the inner surface of the first tray 120 to extend to the top of the first main ice-making cell 121. The first auxiliary ice-making cell 122 may be connected to the first main ice-making cell 121. The first auxiliary ice-making cell 122 may be sunken inward from the inner surface of the first tray 121 in the same direction as the first main ice-making cell 121.

The first tray 120 may include a first inlet 125. The first inlet 125 may be formed to receive a portion of the water-supply guide member 500 to bring in water supplied from the water supplier 60. The first inlet 125 may be connected to the first main ice-making cell 121.

The first tray 120 will be described in detail later.

The first fixing member 130 may include a first ice-making cell cover 131 and a first fixer 132.

The first ice-making cell cover 131 of the first fixing member 130 may cover the sides of the first tray 120 so that the first tray 120 is fixed to the first case 110. The first fixing member 130 may be coupled to the first case 110.

Specifically, a portion of the first tray 120 may be arranged and fixed between the first fixing member 130 and the first case 110. Furthermore, the first main ice-making cell 121 and the first auxiliary ice-making cell 122 of the first tray 120 may be engaged with the opposite second tray 220 through an open portion of the first fixing member 130.

The first fixer 132 may be arranged to be combined with the first tray 120 and the first case 110. An extra fastening member may be inserted through the first fixer 132 to combine the first tray 120, the first case 110 and the first fixing member 130. Accordingly, the first case 110, the first tray 120 and the first fixing member 130 may be arranged to be fixed to the inside of the support frame without movement.

The ice maker 1000 may include the second case 210, the second tray 220 and the second fixing member 230.

The second case 210 may include a second tray receiver 211. The second tray receiver 211 may be provided to receive a portion of the second main ice-making cell 221 of the second tray 220. There may be three second tray receivers 211 corresponding to the number of second main ice-making cells 221.

The second case 210 may include the second through hole 212. The second through hole 212 may be formed by being cut in the center of the second tray receiver 211. The second through hole 212 may be arranged for the second pressurizer 242 of the second ejector 240 to pass through.

The second case 210 may include a second elastic member mounting part 213.

The second elastic member mounting part 213 may be arranged to be connected to the elastic member 450 of the driver 400. The elastic member 450 may be connected to the first elastic member mounting part 443 of the rack gear 440 at one end, and connected to the second elastic member mounting part 213 of the rack gear 440 at the other end. Accordingly, the second case 210 may be moved along with the horizontal movement of the rack gear 440.

The second case 210 may include the projection 214.

The projection 214 may be received in the projection receiving space 1431 formed at the leg 143 of the first ejector 140. The projection 214 of the second case 210 may be arranged to move the first ejector 140 by being engaged with the movement of the second case 210.

The second case 210 may include a second drainage 215.

The second drainage 215 may be formed at an angle on the top surface of the second case 210. The second drainage 215 may be provided to be connected to a first drainage 233 of the second fixing member 230 as described herein.

The second tray 220 may include the second main ice-making cell 221.

The second tray 220 may be coupled to the first tray 120 to form a spherical ice chamber. Specifically, the second main ice-making cell 221 of the second tray 220 may be coupled to the first main ice-making cell 121 of the first tray 120 to form the ice chamber.

For example, the second main ice-making cell 221 may be provided to form a second portion of ice. The second portion of ice refers to the other portion of the ice formed by the first main ice-making cell 121. More specifically, the second main ice-making cell 221 may be provided to form a right portion of the ice. The second main ice-making cell 221 may be formed by being sunken inward from the inner surface of the second tray 220.

The second tray 220 may include the second auxiliary ice-making cell 222. The second auxiliary ice-making cell 222 may be sunken from the inner surface of the first tray 220 to extend to the top of the second main ice-making cell 221. The second auxiliary ice-making cell 222 may be connected to the second main ice-making cell 221.

The second auxiliary ice-making cell 222 may be arranged such that a portion of the second auxiliary ice-making cell 222 comes into contact with the first auxiliary ice-making cell 122. For example, a portion of the second auxiliary ice-making cell 222 may overlap the first auxiliary ice-making cell 122.

The second tray 220 is described herein.

The second fixing member 230 may include a second ice-making cell cover 231 and a second fixer 232.

The second ice-making cell cover 231 of the second fixing member 230 may cover the sides of the second tray 220 so that the second tray 220 is fixed to the second case 210. The second fixing member 230 may be coupled to the second case 210.

Specifically, a portion of the second tray 220 may be arranged and fixed between the second fixing member 230 and the second case 210. Furthermore, the second main ice-making cell 221 and the second auxiliary ice-making cell 222 of the second tray 220 may be engaged with the opposite first tray 120 through an open portion of the second fixing member 230.

The second fixer 232 may be arranged to be coupled with the second tray 220 and the second case 210. An extra fastening member may be inserted through the second fixer 232 to combine the second tray 220, the second case 210 and the second fixing member 230.

Accordingly, the second case 210, the second tray 220 and the second fixing member 230 may be horizontally moved together within the support frame.

Furthermore, the second fixing member 230 may include the first drainage 233. The first drainage 233 may be formed at an angle on the top surface of the second fixing member 230. Details of the first drainage 233 are described herein.

Figure 4:
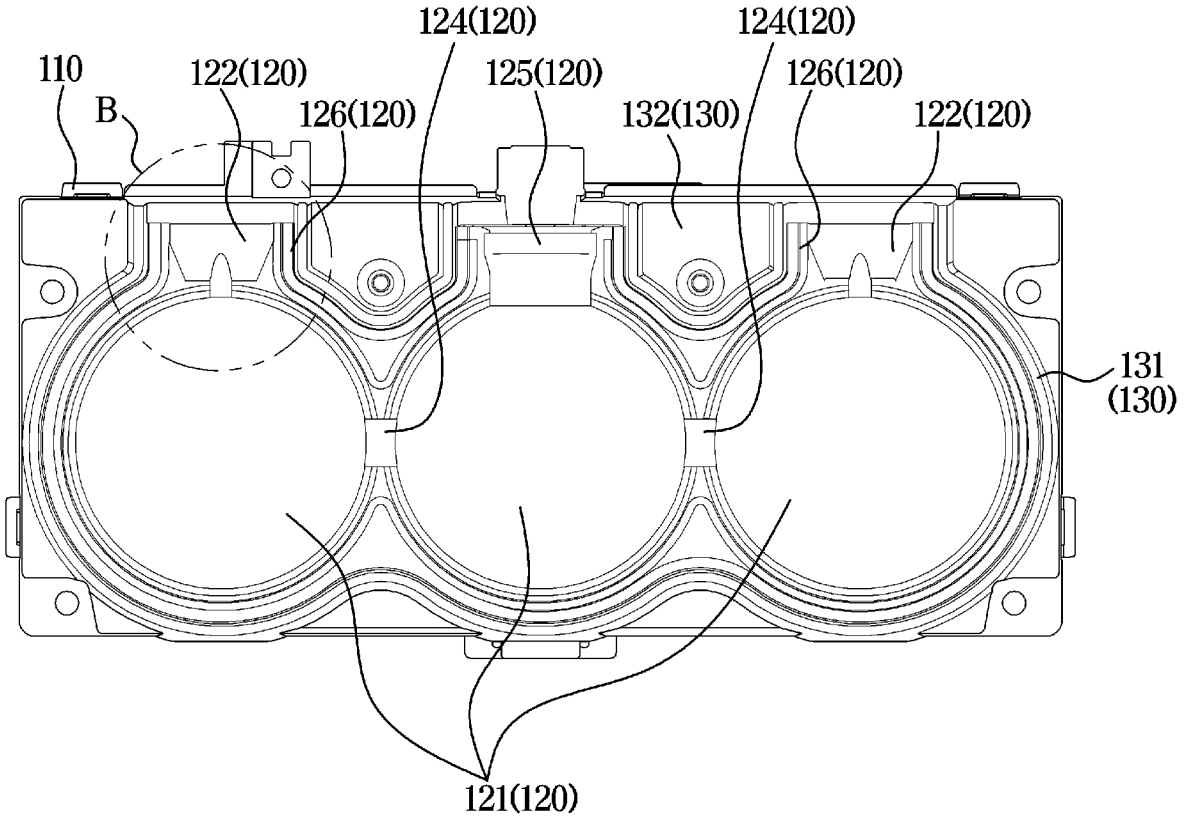
FIG. 4 illustrates a state of a first case, a first tray and a first fixing member shown in FIG. 3 combined, which is viewed from inside, according to an embodiment of the disclosure.
Figure 5:
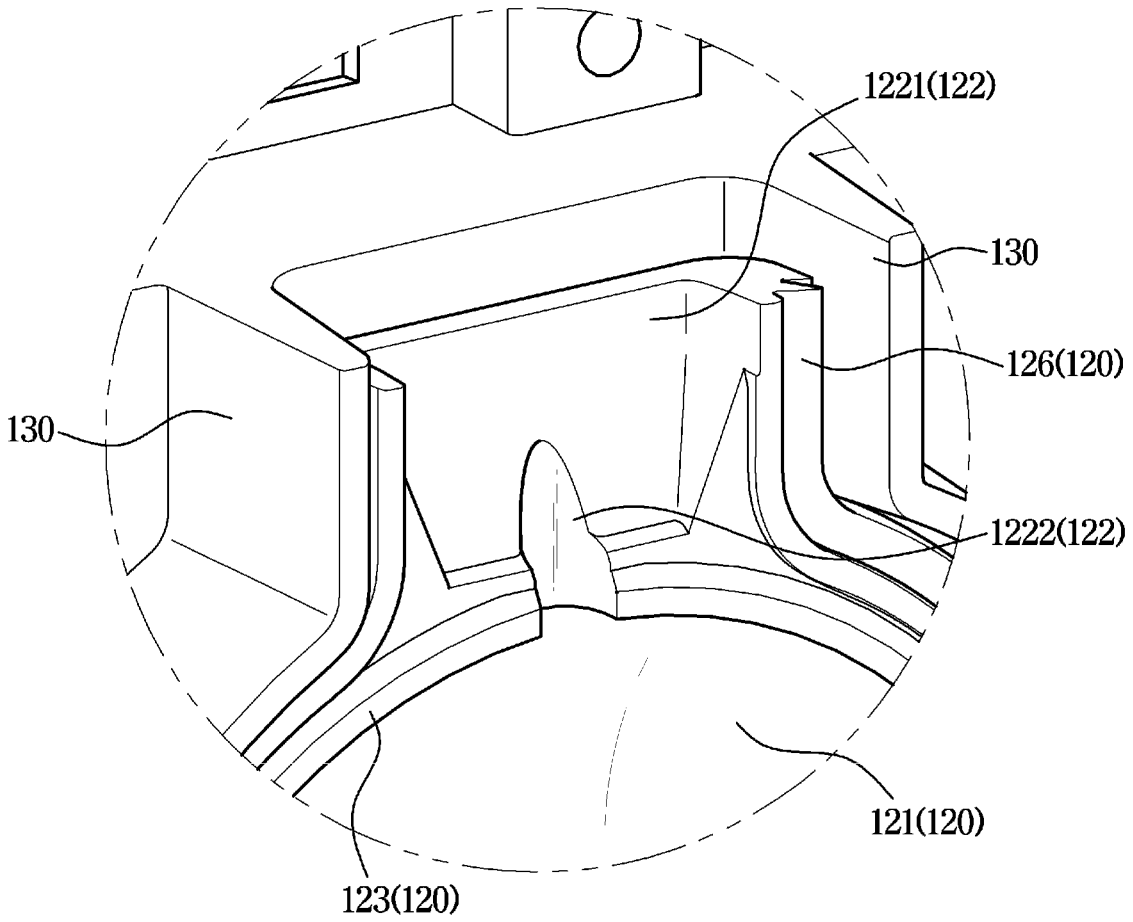
FIG. 5 is an enlarged perspective view of portion B of FIG. 4, according to an embodiment of the disclosure.
Figure 6:
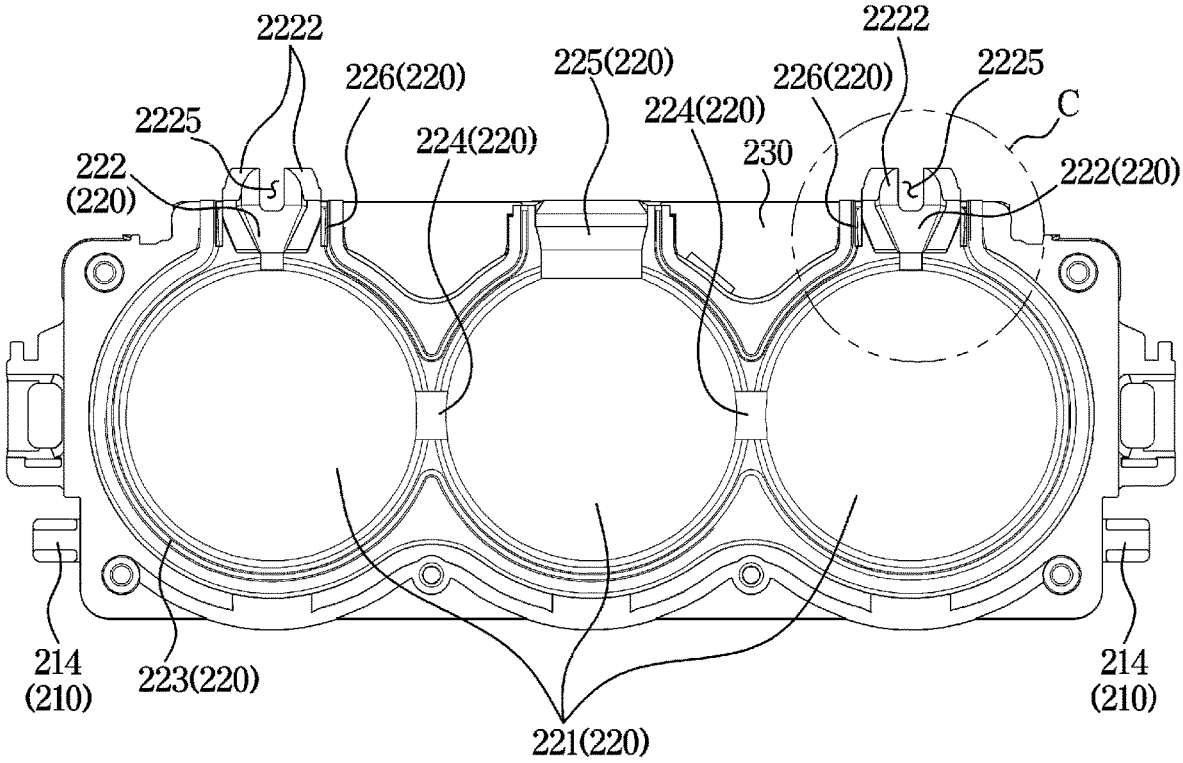
FIG. 6 illustrates a state of a second case, a second tray and a second fixing member shown in FIG. 3 combined, which is viewed from inside, according to an embodiment of the disclosure.
Figure 7:
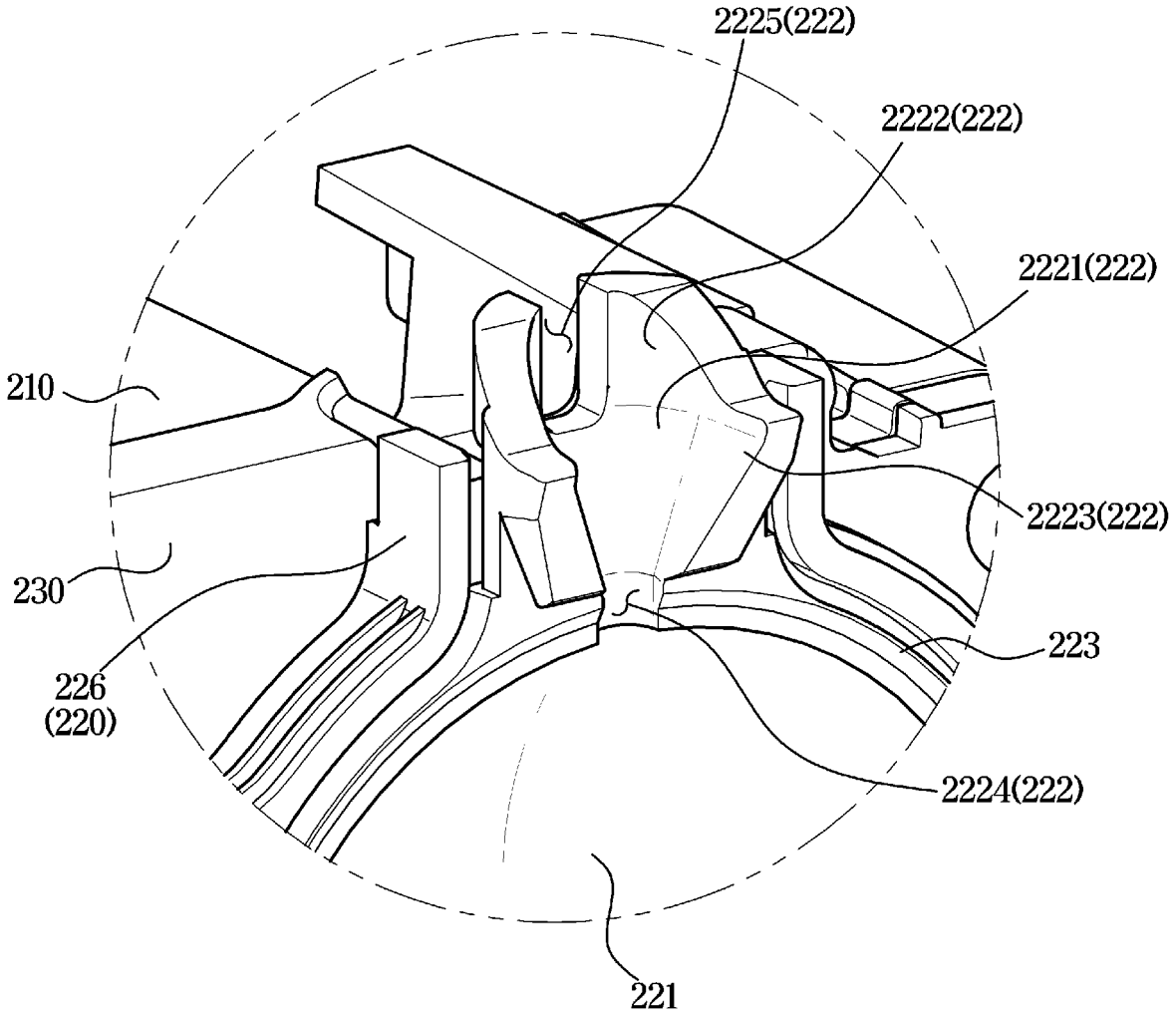
FIG. 7 is an enlarged view of portion C of FIG. 6, according to an embodiment of the disclosure.
Figure 8:
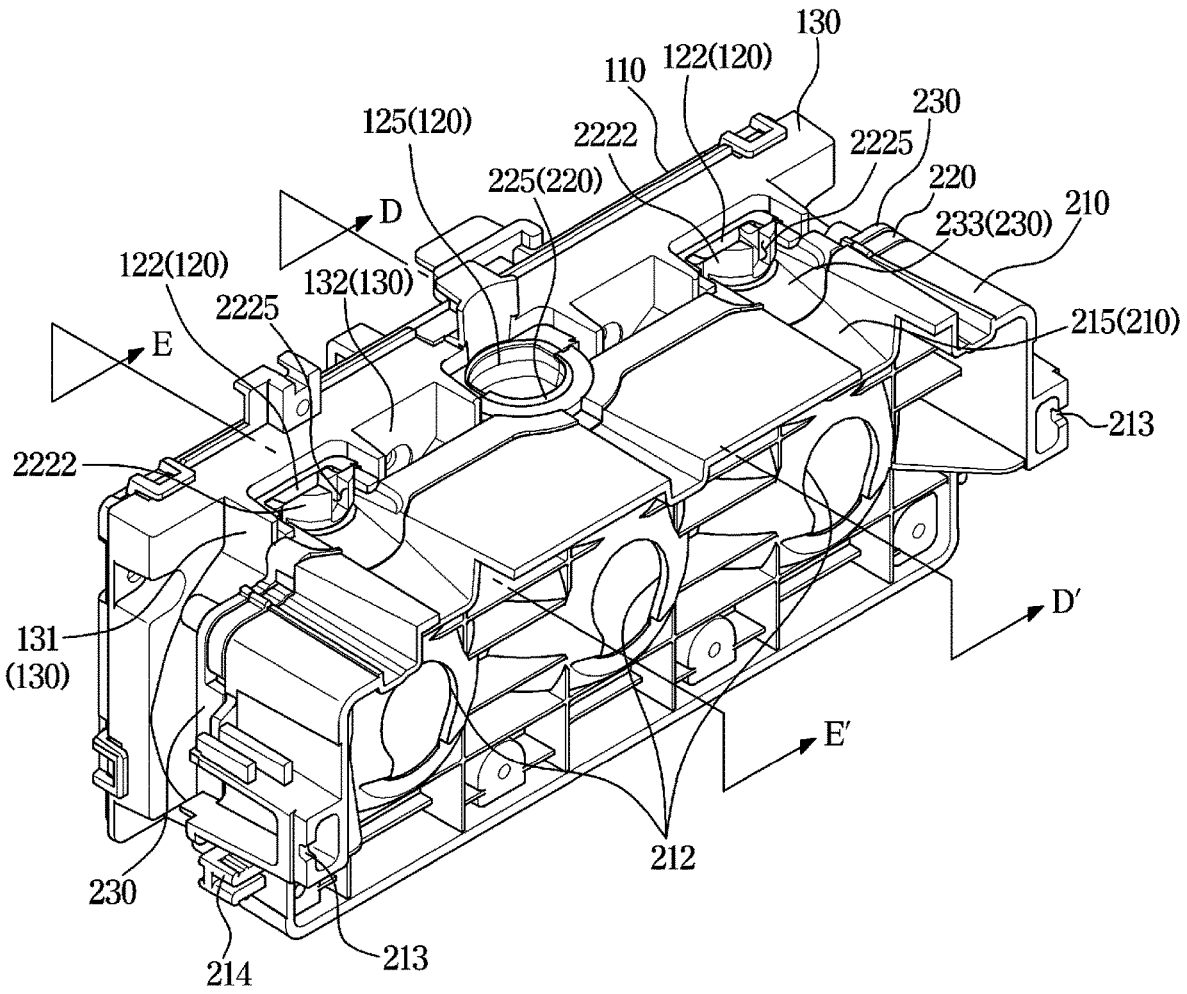
FIG. 8 is a perspective view illustrating a state of some components of an ice maker of a refrigerator combined, according to an embodiment of the disclosure.

FIG. 4 illustrates a state of the first case, the first tray and the first fixing member, which are shown in FIG. 3, combined, which is viewed from inside. FIG. 5 is an enlarged perspective view of portion B of FIG. 4. FIG. 6 illustrates a state of a second case, a second tray and a second fixing member, which are shown in FIG. 3, combined, which is viewed from inside. FIG. 7 is an enlarged view of portion C of FIG. 6. FIG. 8 is a perspective view illustrating a state of some components of an ice maker of a refrigerator combined, according to an embodiment of the disclosure.

Referring to FIGS. 4 and 5, the first tray 120 may include the first main ice-making cell 121 sunken inward from the inner surface, and the first auxiliary ice-making cell 122 extending to the top of the first main ice-making cell 121.

Although FIG. 4 shows the three first main ice-making cells 121, the number of the first main ice-making cells 121 is not limited thereto.

The first auxiliary ice-making cell 122 may be sunken inward from the inner surface of the first tray 120.

The first tray 120 may include a first sealing portion 123. The first sealing portion 123 may be formed to be engaged with the second tray 220 to seal the inside of the first main ice-making cell 121, thereby preventing water leakage between the first tray 120 and the second tray 220.

The first sealing portion 123 may be formed along the boundary of the first main ice-making cell 121.

The first tray 120 may include a first inlet 125. The first inlet 125 is a portion where the water-supply guide member 500 is received, and the water may be supplied to the first main ice-making cell 121 through the first inlet 125.

The first tray 120 may include a first connecting portion 124. The first connecting portion 124 may be arranged between the plurality of first main ice-making cells 121 so that the water flowing into the first main ice-making cell 121 connected to the first inlet 125 flows to the neighboring first main ice-making cell 121. The first connecting portion 124 may be formed by being sunken to the inside of the first tray 120.

As there are three of the first main ice-making cells 121 formed in FIG. 4, two of the first connecting portions 124 may be arranged. Specifically, water may be supplied to the first main ice-making cell 121 at the center through the first inlet 125, and the supplied water may be supplied to the neighboring first main ice-making cells 121 on the left and right through the first connecting portions 124.

The first tray 120 may include a first blocker 126. The first blocker 126 may be formed on the outside of the first sealing portion 123. The first blocker 126 may be provided to prevent water filling up the first auxiliary ice-making cell 122 from overflowing between the first tray 120 and the first fixing member 130. This may facilitate hygiene management of the device because no ice is formed between the first tray 120 and the first fixing member 130 and no ice fragments are caused.

The first auxiliary ice-making cell 122 may include a first link hole 1222 communicated to the first main ice-making cell 121. The first link hole 1222 may be formed for the water filling up from the first main ice-making cell 121 to be supplied to the first auxiliary ice-making cell 122. Furthermore, the first auxiliary ice-making cell 122 may be communicated to the storage chamber. In other words, the first auxiliary ice-making cell 122 may be connected to at least one of the plurality of first main ice-making cells 121 at one end and opened to the storage chamber at the other end.

This enables water to be supplied to the first main ice-making cell 121 through the first inlet 125 and simultaneously, enables air to exit to the first auxiliary ice-making cell 122, thereby keeping the internal pressure constant while forming neatly shaped ice without bubbles.

Furthermore, the ice formed in the first auxiliary ice-making cell 122 may have a narrow lower cross-sectional area due to the first link hole 1222. In other words, as the first link hole 1222 is formed in a small size, a portion where the ice formed in the first auxiliary ice-making cell 122 and the ice formed in the first main ice-making cell 121 join may have a relatively small cross-sectional area. Accordingly, the ice formed in the first auxiliary ice-making cell 122 and the ice formed in the first main ice-making cell 121 may be easily separated at the position where the first link hole 1222 is formed.

The first auxiliary ice-making cell 122 may include a first slope 1221. The first slope 1221 may be formed on a surface connected to the first link hole 1222. The first slope 1221 may extend upward at an angle to grow away from the second auxiliary ice-making cell 222.

The first slope 1221 may be provided to secure a wide space in the first auxiliary ice-making cell 122. Specifically, as the first slope 1221 is formed on the first auxiliary ice-making cell 122, the oversupplied water may be contained in the first auxiliary ice-making cell 122 as much as possible. This may minimize an amount of the oversupplied water overflowing out of the ice maker 1000.

Referring to FIGS. 6 and 7, the second tray 220 may include the second main ice-making cell 221 sunken inward from the inner surface, and the second auxiliary ice-making cell 222 extending to the top of the second main ice-making cell 221.

Although FIG. 6 shows the three second main ice-making cells 221, the number of the second main ice-making cells 221 is not limited thereto. It is enough to have as many second main ice-making cells 221 as the number of the first main ice-making cells 121.

The second auxiliary ice-making cell 222 may be sunken inward from the inner surface of the second tray 220.

The second tray 220 may include a second sealing portion 223. The second sealing portion 223 may be formed to be engaged with the first tray 220 to seal the inside of the second main ice-making cell 221, thereby preventing water leakage between the first tray 120 and the second tray 220.

The second sealing portion 223 may be formed along the boundary of the second main ice-making cell 221.

The second tray 220 may include a second inlet 225. The second inlet 225 is a portion where the water-supply guide member 500 is received, and the water may be supplied to the second main ice-making cell 221 through the second inlet 225. The second inlet 225 may be formed to face the first inlet 125.

The second tray 220 may include a second connecting portion 224. The second connecting portion 224 may be arranged between the plurality of second main ice-making cells 221 so that the water flowing into the second main ice-making cell 221 connected to the second inlet 225 flows to the neighboring second main ice-making cell 221. The second connecting portion 224 may be formed by being sunken to the inside of the second tray 220.

As there are three of the second main ice-making cells 221 formed in FIG. 6, two of the second connecting portions 224 may be arranged. Specifically, water may be supplied to the second main ice-making cell 221 at the center through the second inlet 225, and the supplied water may be supplied to the neighboring second main ice-making cells 221 on the left and right through the second connecting portions 224.

The second tray 220 may include a second blocker 226. The second blocker 226 may be formed on the outside of the second sealing portion 223. The second blocker 226 may be provided to prevent water filling up the second auxiliary ice-making cell 222 from overflowing between the second tray 220 and the second fixing member 230. This may facilitate hygiene management of the device because no ice is formed between the second tray 220 and the second fixing member 230 and no ice fragments are caused.

The second auxiliary ice-making cell 222 may include a second link hole 2224 communicated to the second main ice-making cell 221. The second link hole 2224 may be formed for the water filling up from the second main ice-making cell 221 to be supplied to the second auxiliary ice-making cell 222. Furthermore, the second auxiliary ice-making cell 222 may be communicated to the storage chamber. In other words, the second auxiliary ice-making cell 222 may be connected to at least one of the plurality of second main ice-making cells 221 at one end and opened to the storage chamber at the other end.

This enables water to be supplied to the second main ice-making cell 221 through the second inlet 225 and enables air to exit to the second auxiliary ice-making cell 222, thereby keeping the internal pressure constant while forming neatly shaped ice without bubbles.

Furthermore, the ice formed in the second auxiliary ice-making cell 222 may have a narrow lower cross-sectional area due to the second link hole 2224. In other words, as the second link hole 2224 is formed in a small size, a portion where the ice formed in the second auxiliary ice-making cell 222 and the ice formed in the second main ice-making cell 221 join may have a relatively small cross-sectional area. Accordingly, the ice formed in the second auxiliary ice-making cell 222 and the ice formed in the second main ice-making cell 221 may be easily separated at the position where the second link hole 2224 is formed.

The second auxiliary ice-making cell 222 may include a second slope 2221. The second slope 2221 may be formed on a surface connected to the second link hole 2224. The second slope 2221 may extend upward at an angle to grow away from the first auxiliary ice-making cell 122.

The second slope 2221 may be formed to secure a wide space in the second auxiliary ice-making cell 222. Specifically, as the second slope 2221 is formed on the second auxiliary ice-making cell 222, the oversupplied water may be contained in the second auxiliary ice-making cell 222 as much as possible. This may minimize an amount of the oversupplied water overflowing out of the ice maker 1000.

The second slope 2221 may have a larger sloping angle than the first slope 1221. The sloping angle refers to a degree of inclination of the second slope 2221 to the vertical direction. In other words, the first slope 1221 may extend at a shallower angle than the second slope 2221.

The first auxiliary ice-making cell 122 and the second auxiliary ice-making cell 222 may extend to the top of the first main ice-making cell 121 and the second main ice-making cell 221, respectively. The water oversupplied into the space formed by the first main ice-making cell 121 and the second main ice-making cell 221 may flow between the first auxiliary ice-making cell 122 and the second auxiliary ice-making cell 222 and may be formed into ice between the first auxiliary ice-making cell 122 and the second auxiliary ice-making cell 222.

In this case, as the second slope 2221 of the second auxiliary ice-making cell 222 is formed at a larger angle than the first slope 1221 of the first auxiliary ice-making cell 122, more water may be contained in the second auxiliary ice-making cell 222. That is, the second auxiliary ice-making cell 222 may be formed to have a larger inside volume.

Accordingly, the ice formed in the first auxiliary ice-making cell 122 and the second auxiliary ice-making cell 222 is more likely to stick to the second auxiliary ice-making cell 222 when the second tray 220 is moved to be separated from the first tray 120. In other words, the second auxiliary ice-making cell 222 is formed to have a large ice contact area so that an unnecessary portion of the ice may be stuck to and moved along with the second tray 220.

The second tray 220 may include a projection 2222. Specifically, the second auxiliary ice-making cell 222 may include the projection 2222 that extends upward to interfere with the pressurizing member 430.

The projection 2222 may protrude upward farther than the top surfaces of the second fixing member 230 and the first case 110. Accordingly, the pressurizing member 430 may interfere with the projection 2222 without interfering with other components when the second tray 220 is moved.

The projection 2222 may be formed of an elastic material that is deformed in shape when pressurized by the pressurizing member 430. Accordingly, the ice stuck to the second auxiliary ice-making cell 222 may be separated from the second tray 220 as the projection 222 is pressurized by the pressurizing member 430. In other words, the ice stuck to the second auxiliary ice-making cell 222 may be separated from ice stuck to the second main ice-making cell 221 as the projection(s) 222 is pressurized by the pressurizing member 430. This will be described in detail herein.

The second tray 220 may include a drain groove 2225.

The drain groove 2225 may be formed by cutting a portion of the projection 2222. Specifically, the drain groove 2225 may be formed by cutting a center portion of the projection 2222. The drain groove 2225 may be formed for water filling up between the first auxiliary ice-making cell 122 and the second auxiliary ice-making cell 222 to flow out when the water is oversupplied. This may prevent the ice formed between the first auxiliary ice-making cell 122 and the second auxiliary ice-making cell 222 from having a size higher than a certain height. Furthermore, this may allow the oversupplied water not to flow to the other parts of the ice maker 1000 but to flow backward along the second tray 220, the second fixing member 230 and the second drain 215 and fall down to the ice bucket. This drain mechanism is described in detail herein.

The second tray 220 may include an extension 2223.

The extension 2223 may be formed at the second auxiliary ice-making cell 222. The extension 2223 may extend from the second auxiliary ice-making cell 222 toward the first auxiliary ice-making cell 122. The extension 2223 may be received in the first auxiliary ice-making cell 122. The extension 2223 may be formed to have a shape corresponding to the sloping angle of the first slope 1221 of the first auxiliary ice-making cell 122.

With the extension 2223 formed at the second auxiliary ice-making cell 222, the ice formed between the first auxiliary ice-making cell 122 and the second auxiliary ice-making cell 222 may come into contact with the second slope 2221 and the extension 2223 of the second auxiliary ice-making cell 222, and a portion of the first slope 1221 of the first auxiliary ice-making cell 122. In other words, most of the ice formed between the first auxiliary ice-making cell 122 and the second auxiliary ice-making cell 222 may come into contact with the second auxiliary ice-making cell 222.

Hence, when the second tray 220 is separated from the first tray 120, the ice formed in the first auxiliary ice-making cell 122 and the second auxiliary ice-making cell 222 may have high adhesive power with the second auxiliary ice-making cell 222, and may be separated from the first auxiliary ice-making cell 122 along with the second tray 220 while stuck to the second auxiliary ice-making cell 222. The separated ice may then be separated from the second tray 220 when the second auxiliary ice-making cell 222 is pressurized by the pressurizing member 430.

Hence, the extension 2223 of the second auxiliary ice-making cell 222 may be formed to widen the ice contact area formed between the first auxiliary ice-making cell 122 and the second auxiliary ice-making cell 222.

Figure 9:
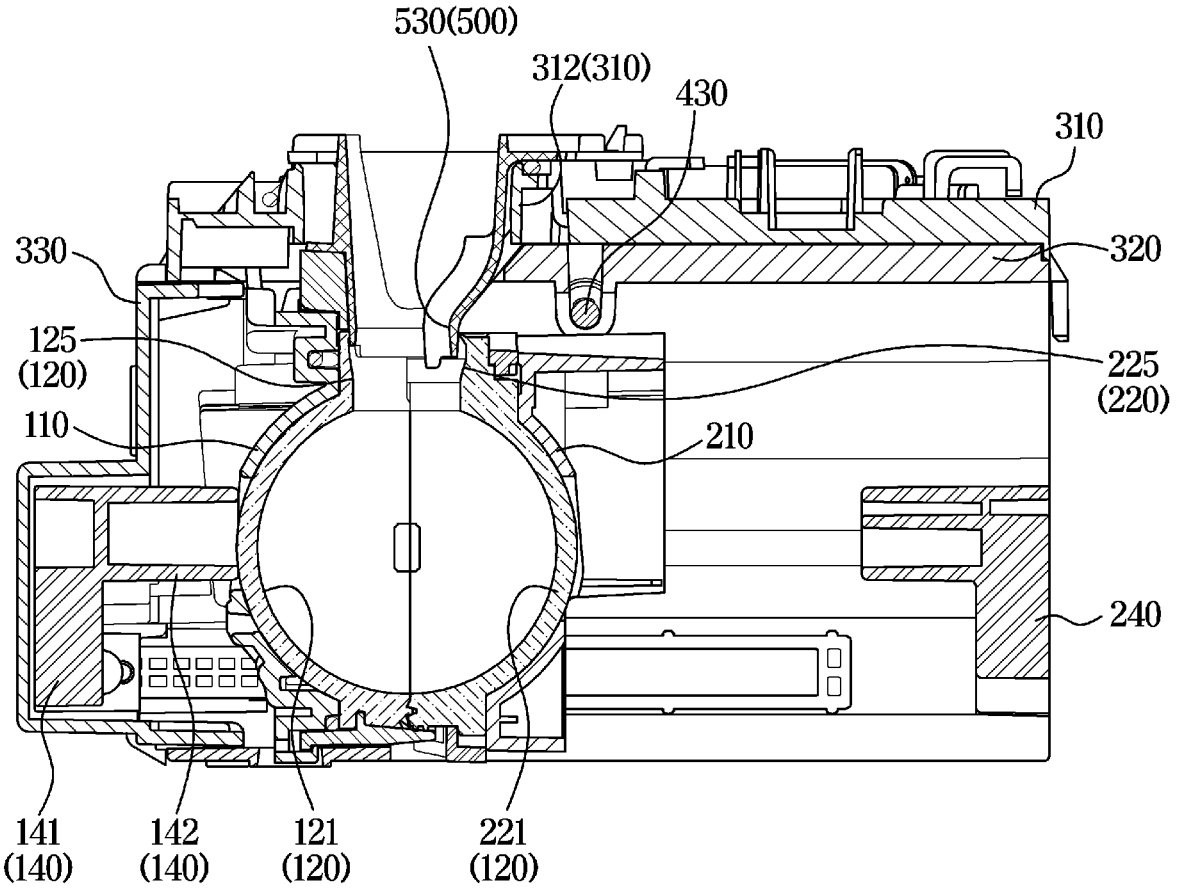
FIG. 9 is a cross-sectional view of an ice maker along line D-D' of FIG. 8, according to an embodiment of the disclosure.

FIG. 9 is a cross-sectional view of the ice maker along line D-D' of FIG. 8.

Referring to FIG. 9, a procedure for supplying water into the ice maker 1000 will be described.

The water supplier 60 (see FIG. 2) may be provided to supply water to the water-supply guide member 500. The supplier 530 of the water-supply guide member 500 may be arranged between the first tray 120 and the second tray 220 to supply water into the first tray 120 and the second tray 220.

Specifically, the supplier 530 of the water-supply guide member 500 may be arranged between the first inlet 125 of the first tray 120 and the second inlet 225 of the second tray 220. Accordingly, the water may be supplied to the first main ice-making cell 121 of the first tray 120 and the second main ice-making cell 221 of the second tray 220.

In this case, the first tray 120 and the second tray 220 may be coupled to be engaged with each other.

FIGS. 10 to 14 are cross-sectional views of the ice maker along line E-E' of FIG. 8, which illustrate operations of the ice maker.

Figure 10:
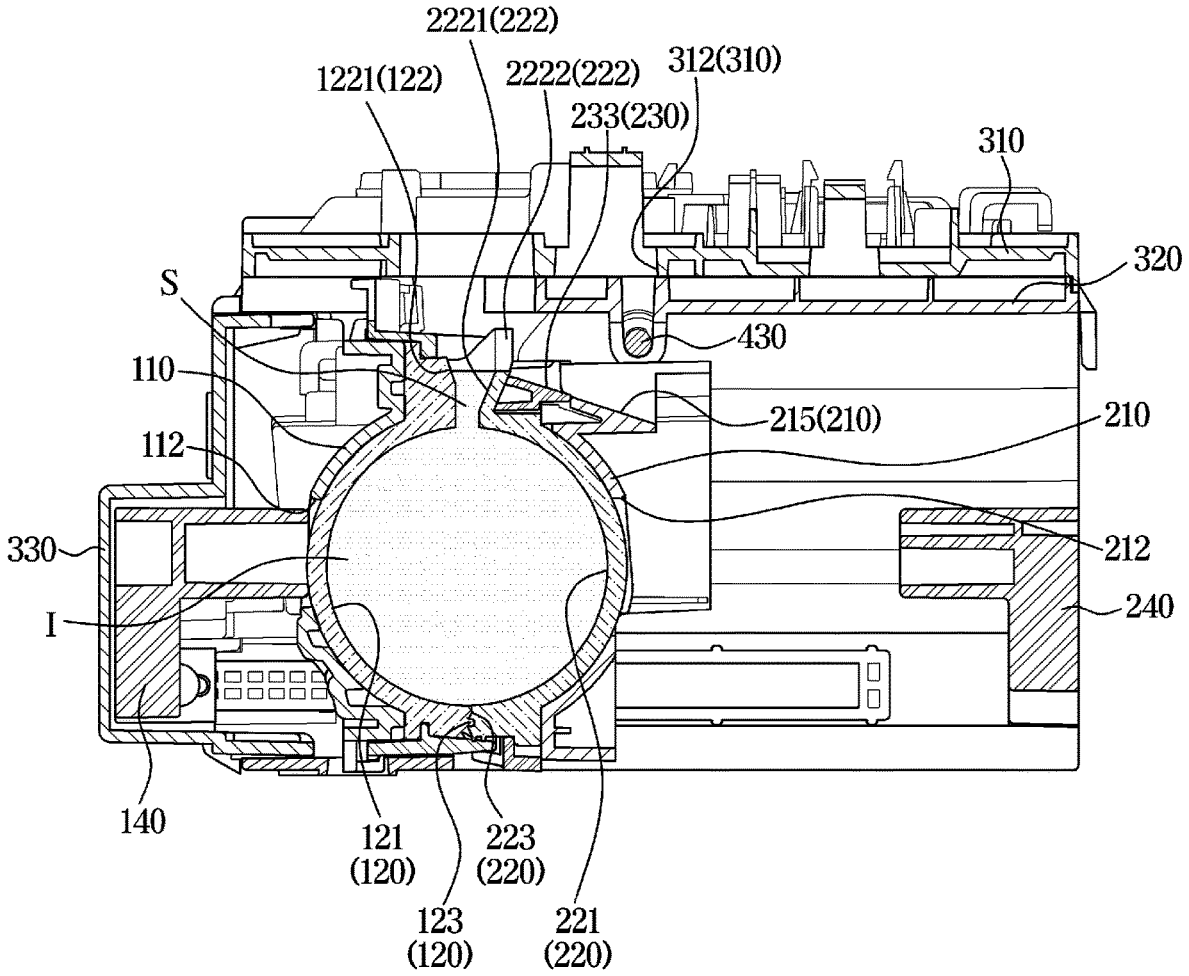
FIGS. 10, 11, 12, 13 and 14 are cross-sectional views of the ice maker along line E-E' of FIG. 8, which illustrate operations of the ice maker, according to an embodiment of the disclosure.

Referring to FIG. 10, as shown in FIG. 9, the water supplied to the first main ice-making cell 121 and the second main ice-making cell 221 at the center through the first inlet 125 and the second inlet 225 may flow to the first main ice-making cells 121 and the second main-ice-making cells 221 on both sides through the first connecting portion 124 (see FIG. 4) and the second connecting portion 224 (see FIG. 6).

The water flowing through the first connecting portion 124 and the second connecting portion 224 may be contained between the first main ice-making cell 121 and the second main ice-making cell 221, and contained between the first auxiliary ice-making cell 122 and the second auxiliary ice-making cell 222 to be formed into ice by cold air.

When a small amount of water is supplied from the supplier 60, a desired shape of ice may not be formed well. Hence, an amount of water to be supplied needs to be set to be greater than a required amount.

Accordingly, ice S may be formed in the first auxiliary ice-making cell 122 and the second auxiliary ice-making cell 222 in addition to ice I formed in the first main ice-making cell 121 and the second main ice-making cell 221 between the first tray 120 and the second tray 220. This may be called an extra (or unnecessary) portion of ice.

Figure 11:
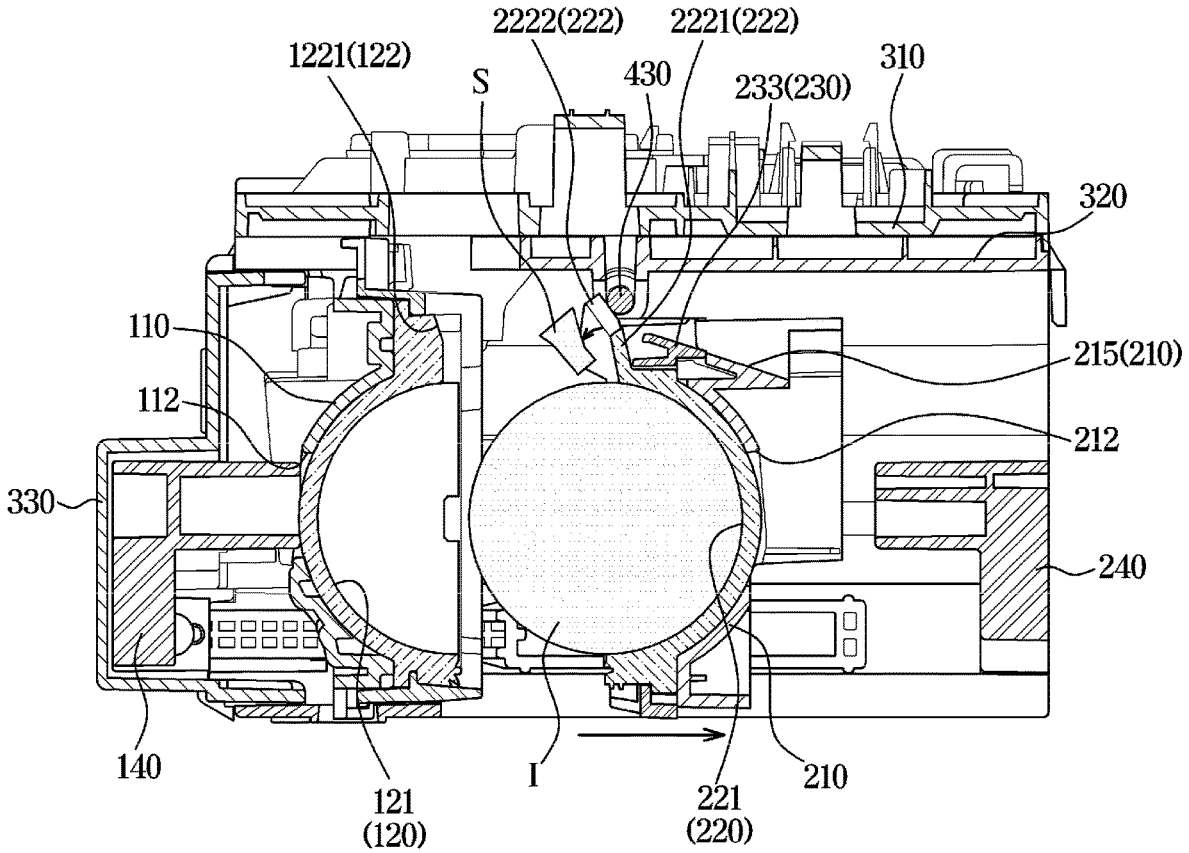

Referring to FIG. 11, the driver 400 may drive the transfer gear 420 to rotate, so the rack gear 440 received on either side of the support frame may be moved horizontally. Accordingly, the second case 210 connected to the rack gear 440 may be moved horizontally. Furthermore, the second tray 220 and the second fixing member 230 may be moved together with the second case 210.

Hence, when the ice is completed, the second tray 220 may be moved in a direction that grows away from the first tray 120 according to driving of the driver 400.

With the movement of the second tray 220, the ice I formed by the first main ice-making cell 121 and the second main ice-making cell 221 may be stuck to the second main ice-making cell 221 and moved with the second tray 220.

The heater 600 arranged behind the first tray 120 may enable the first main ice-making cell 121 and the ice I to be separated by heating the first tray 120 when the ice I is completed before movement of the second tray 220. Accordingly, the ice I formed between the first main ice-making cell 121 and the second main ice-making cell 221 may be moved while stuck to the second main ice-making cell 221 with the movement of the second tray 220.

Furthermore, with the movement of the second tray 220, the ice S formed by the first auxiliary ice-making cell 122 and the second auxiliary ice-making cell 222 may be stuck to the second main ice-making cell 222 and moved with the second tray 220.

Due to the second slope 2221 and the extension 2223 of the second auxiliary ice-making cell 222, the ice formed between the first auxiliary ice-making cell 122 and the second auxiliary ice-making cell 222 may come into contact with the second auxiliary ice-making cell 122 in a larger area than with the first auxiliary ice-making cell 222. As the second auxiliary ice-making cell 222 has strong adhesive power with ice, the ice S formed in the first auxiliary ice-making cell 122 and the second auxiliary ice-making cell 222 may be moved along with the second tray 220 while stuck to the second auxiliary ice-making cell 222.

The projection 2222 of the second auxiliary ice-making cell 222 may be formed to interfere with the pressurizing member 430. Accordingly, as the pressurizing member 430 pressurizes the projection 2222, the second auxiliary ice-making cell 222 may be deformed in shape. Hence, the ice S moving along with the second tray 220 may be separated from the ice I stuck to the second main ice-making cell 221.

As described above, the first link hole 1222 connecting between the first main ice-making cell 121 and the first auxiliary ice-making cell 122 and the second link hole 2224 connecting between the second main ice-making cell 221 and the second auxiliary ice-making cell 222 are formed to have a small size, so a lower portion of the ice S may have a narrow cross-sectional area than an upper portion.

Hence, external force of the pressurizing member 430 may easily separate the ice S from the ice I formed in the first main ice-making cell 121 and the second main ice-making cell 221 at the joining portion.

Figure 12:
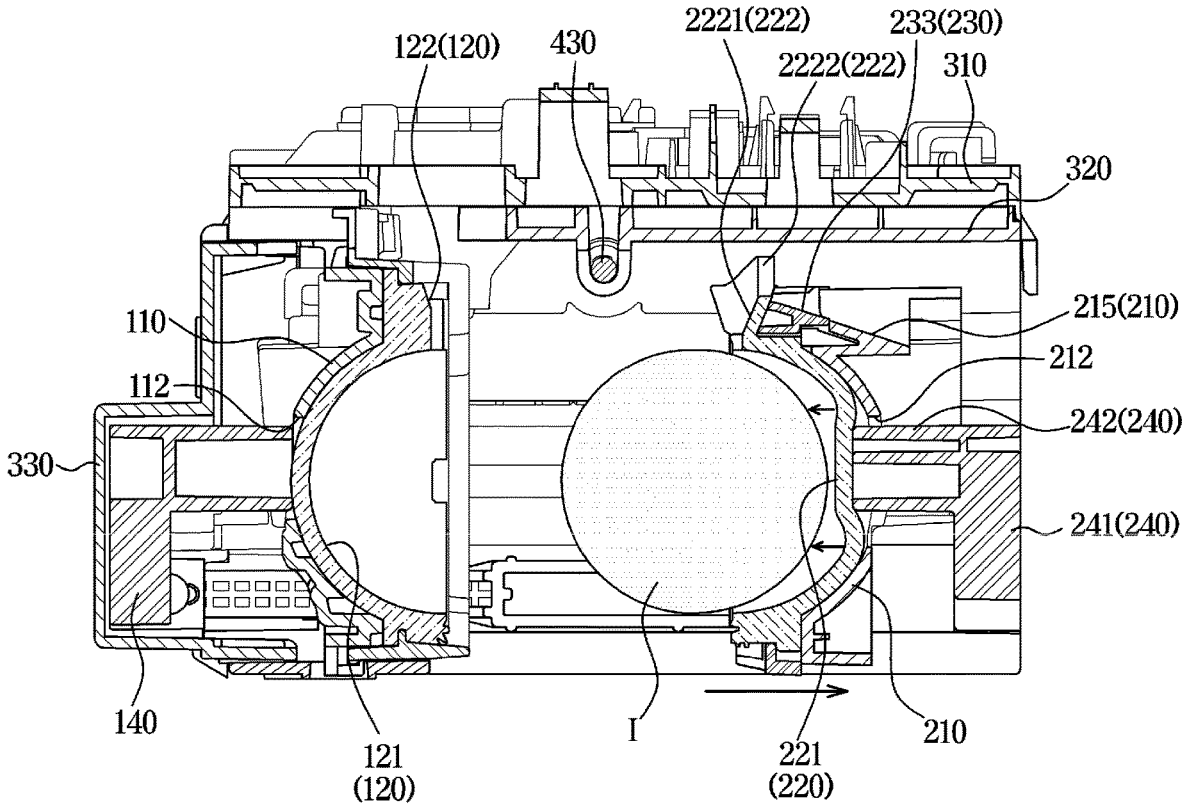

Referring to FIG. 12, the second tray 220 may be further moved in a direction that grows away from the first tray 120. In this case, the second case 210 and the second fixing member 230 may be moved along with the second tray 220.

The ice I stuck to the second main ice-making cell 221 may be pressurized by the second pressurizer 242 as the second case 210 and the second tray 220 are moved toward the second ejector 240. Specifically, the second pressurizer 242 of the second ejector 240 may pressurize the second tray 220 through the second through hole 212 of the second case 210.

The second tray 220 is formed of an elastic material, and may be deformed in shape by pressure of the second ejector 240. Hence, the ice I contained in the second tray 220 may be separated from the second tray 220. The ice I separated may be stored in the ice bucket 40 (see FIG. 2) arranged under the ice maker 1000.

Figure 13:
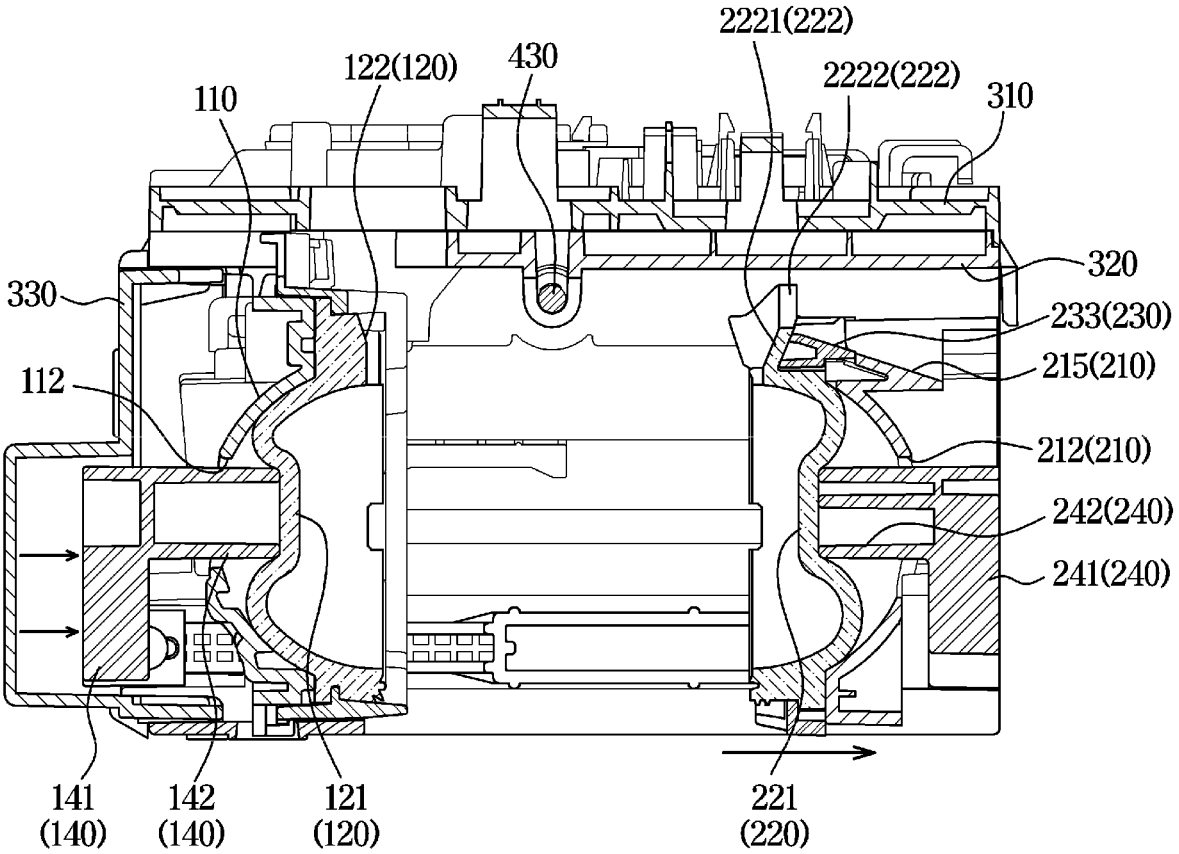

Referring to FIG. 13, the second tray 220 and the second case 210 may be further moved from the state of FIG. 12 to a direction that grows away from the first tray 120.

Accordingly, the first ejector 140 may be moved toward the first case 110. The first pressurizer 142 of the first ejector 140 may pass the first through hole 112 of the first case 110 to pressurize the first tray 120.

As the projection 214 (see FIG. 3) of the second case 210 interferes with the leg 143 (see FIG. 3) of the first ejector 140, the first ejector 140 may be moved in a direction of movement of the second case 210.

When the second case 210 is moved to a direction that gets near to the first case 110, the projection 214 of the second case 210 interferes back with the leg 143 of the first ejector 140 so that the first ejector 140 may be moved along the direction of movement of the second case 210.

In this case, the first ejector 140 may be moved toward the cover frame 330 to be received in the ejector receiver 331 of the cover frame 330 and placed in the right position.

The first tray 120 may be formed of an elastic material, and may be deformed in shape by pressure of the first ejector 140. Even when the ice I is not stuck to the second tray 220 but stuck to the first tray 120, the ice I may be separated from the first tray 120 by the first ejector 140.

Figure 14:
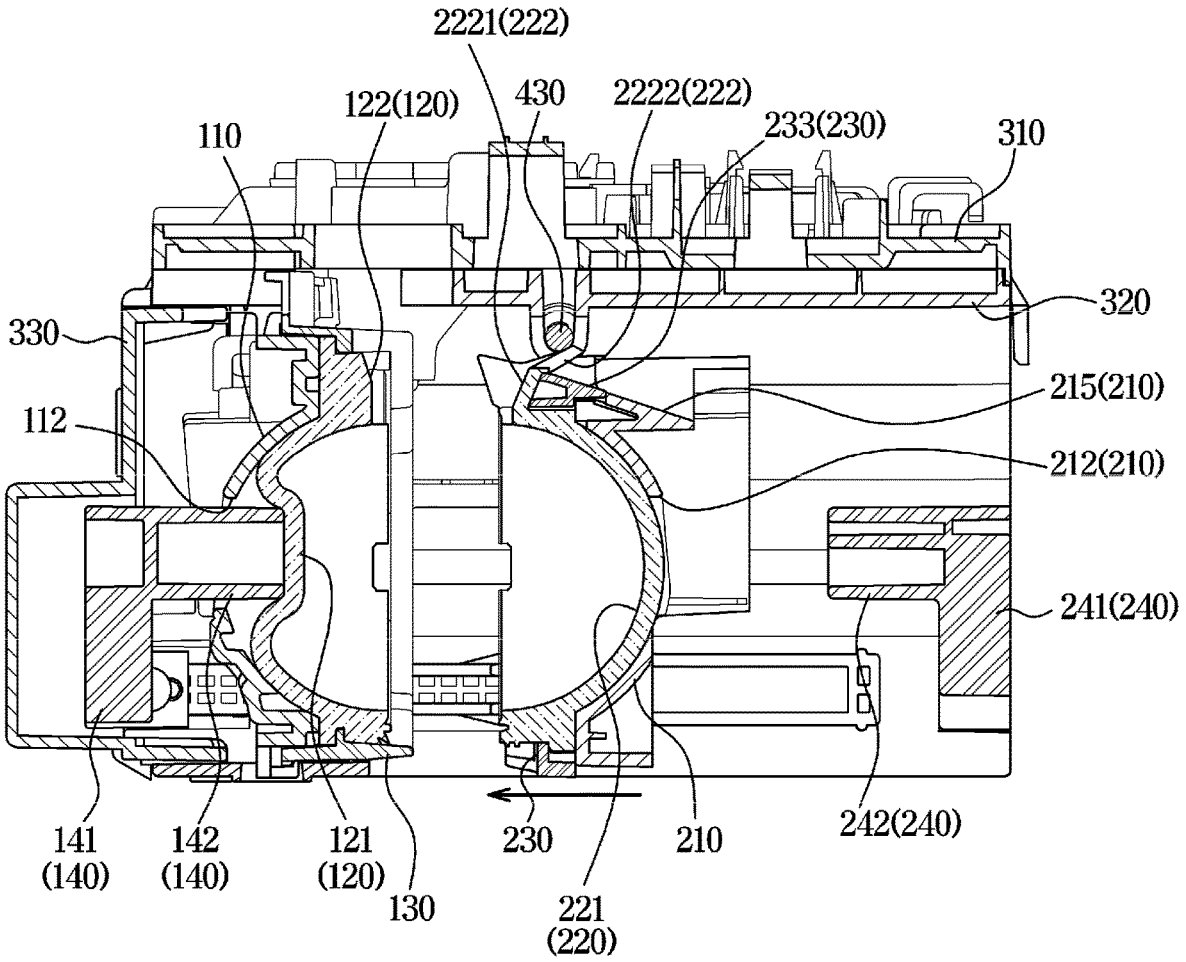

Referring to FIG. 14, the second case 210, the second tray 220 and the second fixing member 230 may return to the direction that gets near to the first tray 120 after transferring the ice.

In this case, the pressurizing member 430 may interfere back with the projection 2222 of the second auxiliary ice-making cell 222. This may remove the ice S from the second tray 220, which has not been separated from but remains in the second auxiliary ice-making cell 222.

In the refrigerator 1 according to an embodiment of the disclosure, the pressurizing member 430 is shown and described as a shaft provided to connect a pair of the transfer gears 420. The form of the pressurizing member 430 is not, however, limited thereto.

For example, the pressurizing member 430 may protrude downward from the inside of the top surface of the support frame to interfere with the projection 2222 of the second tray 220. Furthermore, the pressurizing member 430 may protrude toward the second tray 220 from the inner surface of a side of the support frame to interfere with the projection 2222 of the second tray 220.

Alternatively, the pressurizing member 430 may be arranged to interfere with the slope 2221 of the second auxiliary ice-making cell 222.

The slope 2221 of the second auxiliary ice-making cell 222 may be formed of an elastic material. At least a portion of the second auxiliary ice-making cell 222 may be formed of an elastic material. The second auxiliary ice-making cell 222 may be formed of the same material as a material of the second main ice-making cell 221. Alternatively, the second auxiliary ice-making cell 222 may be formed of a similar material to the material of the second main ice-making cell 221.

The second auxiliary ice-making cell 222 may have a relatively thin thickness as compared to the second main ice-making cell 221. This may make the pressurizing member 430 pressurize the second auxiliary ice-making cell 222 more easily. Furthermore, even when the pressurizing member 430 pressurizes the second auxiliary ice-making cell 222, deformation of the shape of the second main ice-making cell 221 may be minimized.

Accordingly, the pressurizing member 430 may separate the ice S received by the slope 2221 from the ice I contained in the second main ice-making cell 221 by pressurizing the slope 2221 of the second auxiliary ice-making cell 222.

As such, the pressurizing member 430 may be provided as a separate component as described above in the description of the refrigerator 1 according to the embodiment of the disclosure, and may be designed to have more various types because the pressurizing member 430 may be integrally formed with a component in the ice maker 1000 as long as the pressurizing member 430 has the form that interferes with the projection 2222 of the second tray 220.

In an embodiment of the disclosure, the ice maker 1000 may have the projection 2222 formed at the movable second auxiliary ice-making cell 222, so that an unnecessary portion of ice may be removed from the ice to thereby form a desired shape of ice by interference between the pressurizing member 430 and the projection 2222. Accordingly, the ice finally formed may give an improved aesthetic feeling.

Furthermore, the first tray 120 and the second tray 220 of the ice maker 1000 according to an embodiment of the disclosure are not limited to the example, but may be variously designed including a case in which the second auxiliary ice-making cell 222 has a larger area than the first auxiliary ice-making cell 221.

Moreover, according to an embodiment of the disclosure, the ice maker 1000 may form more hygienic ice because there may be no remaining ice in the first tray 120 and the second tray 220.

Figure 15:
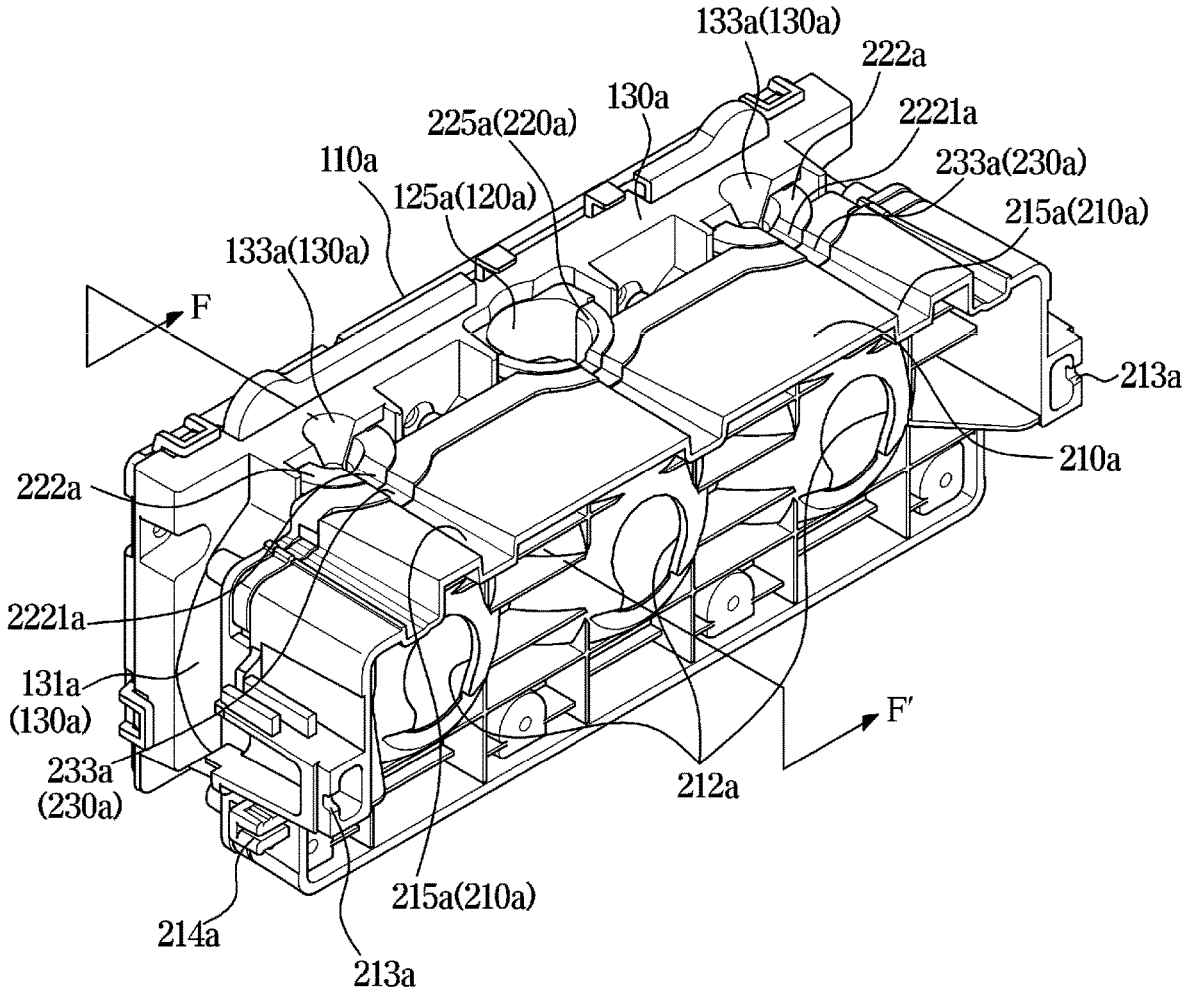
FIG. 15 is a perspective view illustrating a state of some components of an ice maker of a refrigerator combined, according to another embodiment of the disclosure.
Figure 16:
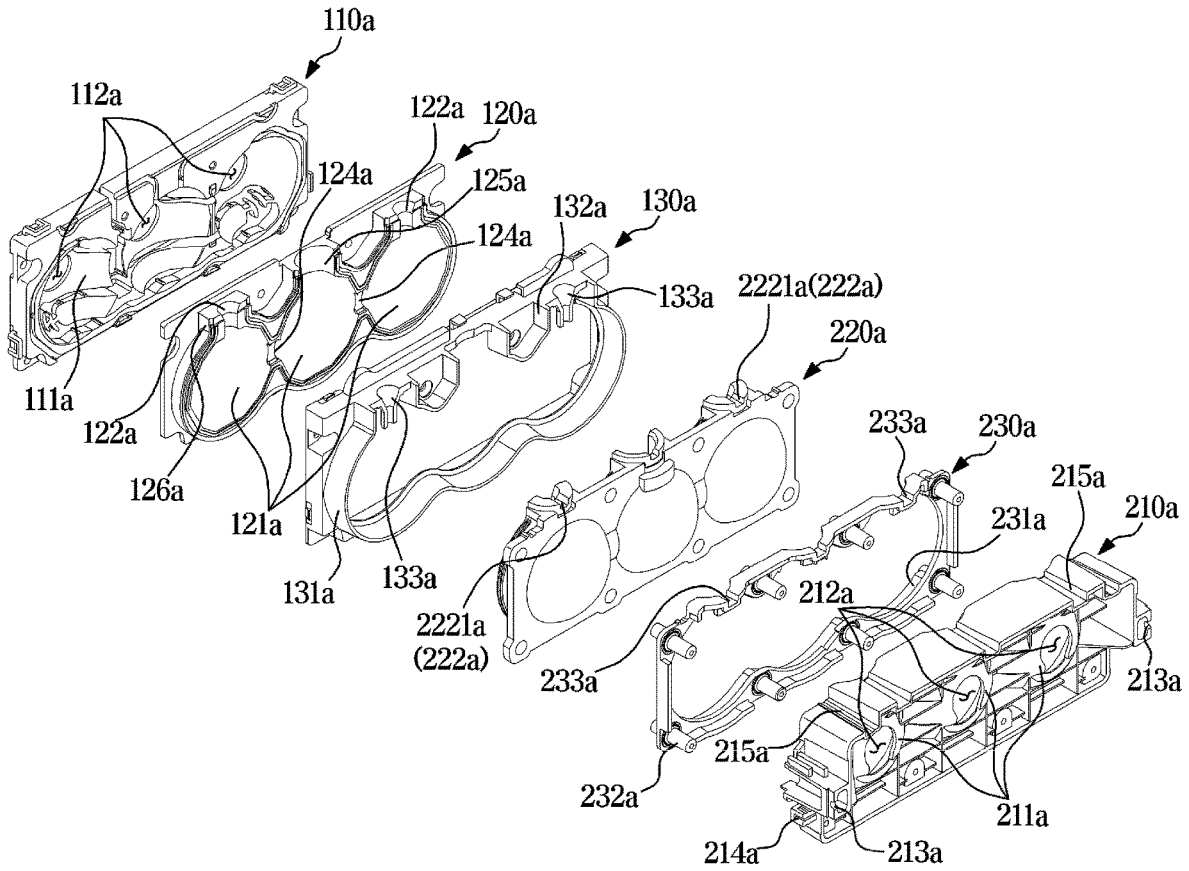
FIG. 16 is an exploded view of what is shown in FIG. 15, according to an embodiment of the disclosure.

FIG. 15 is a perspective view illustrating a state of some components of an ice maker of a refrigerator combined, according to another embodiment of the disclosure. FIG. 16 is an exploded view of what is shown in FIG. 15.

In the following description, a difference from the ice maker according to the aforementioned embodiment of the disclosure will be focused. Like elements for which no extra description is provided will use like reference numerals.

An ice maker according to this embodiment of the disclosure may include a first fixing member that is different from the first fixing member of the ice maker according to the previous embodiment of the disclosure.

Referring to FIGS. 15 and 16, the ice maker may include a first case 110*a*, a first tray 120*a* and a first fixing member 130*a*.

The first case 110*a* may include a first tray receiver 111*a*. The first tray receiver 111*a* may be provided to receive a portion of a first main ice-making cell 121*a* of the first tray 120*a*. There may be three first tray receivers 111*a* corresponding to the number of first main ice-making cells 121*a*.

The first case 110*a* may include a first through hole 112*a*. The first through hole 112*a* may be formed by being cut in the center of the first tray receiver 111*a*. The first through hole 112*a* may be formed for a pressurizer of a first ejector to pass through.

The first tray 120*a* may include the first main ice-making cell 121*a*. The first tray 120*a* may be fixed to the support frame. The first main ice-making cell 121*a* may be provided to form a first portion of ice. Specifically, the first main ice-making cell 121*a* may be provided to form a left portion of the ice. The first main ice-making cell 121*a* may be formed by being sunken inward from the inner surface of the first tray 120*a*.

The first tray 120*a* may include a first auxiliary ice-making cell 122*a*. The first auxiliary ice-making cell 122*a* may be sunken from the inner surface of the first tray 120*a* to extend to the top of the first main ice-making cell 121*a*. The first auxiliary ice-making cell 122*a* may be connected to the first main ice-making cell 121*a*.

The first tray 120*a* may include a first inlet 125*a*. The first inlet 125*a* may be arranged to receive a portion of the water-supply guide member 500 to bring in water supplied from the water supplier 60. The first inlet 125*a* may be connected to the first main ice-making cell 121*a*.

The first tray 120*a* will be described in detail herein.

A first fixing member 130*a* may include a first ice-making cell cover 131*a* and a first fixer 132*a*.

The first ice-making cell cover 131*a* of the first fixing member 130*a* may cover the sides of the first tray 120*a* so that the first tray 120*a* is fixed to the first case 110*a*. The first fixing member 130*a* may be coupled to the first case 110*a*.

Specifically, a portion of the first tray 120*a* may be arranged and fixed between the first fixing member 130*a* and the first case 110*a*. Furthermore, the first main ice-making cell 121*a* and the first auxiliary ice-making cell 122*a* of the first tray 120*a* may be engaged with the opposite second tray 220*a* through an open portion of the first fixing member 130*a*.

The first fixer 132*a* may be arranged to be coupled with the first tray 120*a* and the first case 110*a*. An extra fastening member may be inserted through the first fixer 132*a* to combine the first tray 120*a*, the first case 110*a* and the first fixing member 130*a*. Accordingly, the first case 110*a*, the first tray 120*a* and the first fixing member 130*a* may be arranged to be fixed to the inside of the support frame without movement.

Unlike the ice maker according to the previous embodiment of the disclosure, the first fixing member 130*a* of the ice maker according to this embodiment of the disclosure may include an auxiliary ice-making cell insert 133*a*. The auxiliary ice-making cell insert 133*a* may be received inside the first auxiliary ice-making cell 122*a* of the first tray 120*a*. This will be described herein in detail.

The ice maker may include a second case 210*a*, a second tray 220*a* and a second fixing member 230*a*.

The second case 210*a* may include a second tray receiver 211*a*. The second tray receiver 211*a* may be provided to receive a portion of a second main ice-making cell 221*a* of the second tray 220*a*. There may be three, or more, second tray receivers 211*a* corresponding to the number of second main ice-making cells 221*a*.

The second case 210*a* may include a second through hole 212*a*. The second through hole 212*a* may be formed by being cut in the center of the second tray receiver 211*a*. The second through hole 212*a* may be formed for a second pressurizer of a second ejector to pass through.

The second case 210*a* may include a second elastic member mounting part 213*a*.

The second elastic member mounting part 213*a* may be arranged to be connected to the elastic member 450 of the driver. The elastic member 450 may be connected to the first elastic member mounting part 443 of the rack gear 440 at one end, and connected to the second elastic member mounting part 213*a* of the second case 210*a* at the other end. Accordingly, the second case 210*a* may be moved along with the horizontal movement of the rack gear 440.

The second case 210*a* may include a projection 214*a*.

The projection 214*a* may be received in the projection receiving space 1431 formed at the leg 143 of the first ejector 140. The projection 214*a* of the second case 210*a* may be arranged to move the first ejector 140 by being engaged with the movement of the second case 210*a*.

The second case 210*a* may include a second drainage 215*a*.

The second drainage 215*a* may be formed at an angle on the top surface of the second case 210*a*. The second drainage 215*a* may be provided to be connected to a first drainage 233*a* of a second fixing member 230*a* described herein.

The second tray 220*a* may include a second main ice-making cell 221*a*.

The second main ice-making cell 221*a* may be provided to form a second portion of ice. The second portion of ice refers to the other portion of the ice formed by the first main ice-making cell 121*a*. More specifically, the second main ice-making cell 221*a* may be provided to form a right portion of the ice. The second main ice-making cell 221*a* may be formed by being sunken inward from the inner surface of the second tray 220*a*.

The second tray 220*a* may include the second auxiliary ice-making cell 222*a*. The second auxiliary ice-making cell 222*a* may be sunken from the inner surface of the first tray 220*a* to extend to the top of the second main ice-making cell 221*a*. The second auxiliary ice-making cell 222*a* may be connected to the second main ice-making cell 221*a*.

The second tray 220*a* is described in detail herein.

A second fixing member 230*a* may include a second ice-making cell cover 231*a* and a second fixer 232*a*.

The second ice-making cell cover 231*a* of the second fixing member 230*a* may cover the sides of the second tray 220*a* so that the second tray 220*a* is fixed to the second case 210*a*. The second fixing member 230*a* may be coupled to the second case 210*a*. Specifically, a portion of the second tray 220*a* may be arranged and fixed between the second fixing member 230*a* and the second case 210*a*. Furthermore, the second main ice-making cell 221*a* and the second auxiliary ice-making cell 222*a* of the second tray 220*a* may be engaged with the opposite first tray 120*a* through an open portion of the second fixing member 230*a*.

The second fixer 232*a* may be arranged to be coupled with the second tray 220*a* and the second case 210*a*. An extra fastening member (not shown) may be inserted through the second fixer 232*a* to combine the second tray 220*a*, the second case 210*a* and the second fixing member 230*a*.

Accordingly, the second case 210*a*, the second tray 220*a* and the second fixing member 230*a* may be horizontally moved together within the support frame.

Furthermore, the second fixing member 230*a* may include the first drainage 233*a*. The first drainage 233*a* may be formed at an angle on the top surface of the second fixing member 230*a*.

Figure 17:
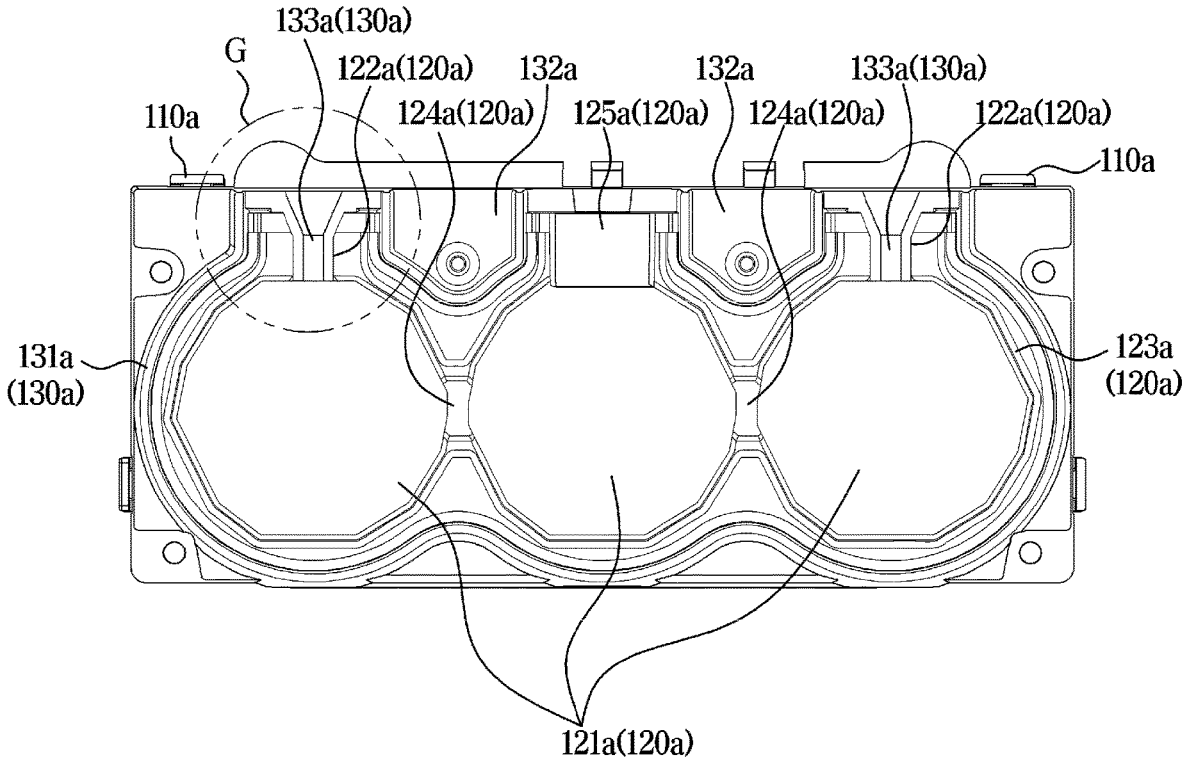
FIG. 17 illustrates a state of a first case, a first tray and a first fixing member shown in FIG. 15 combined, which is viewed from inside, according to an embodiment of the disclosure.
Figure 18:
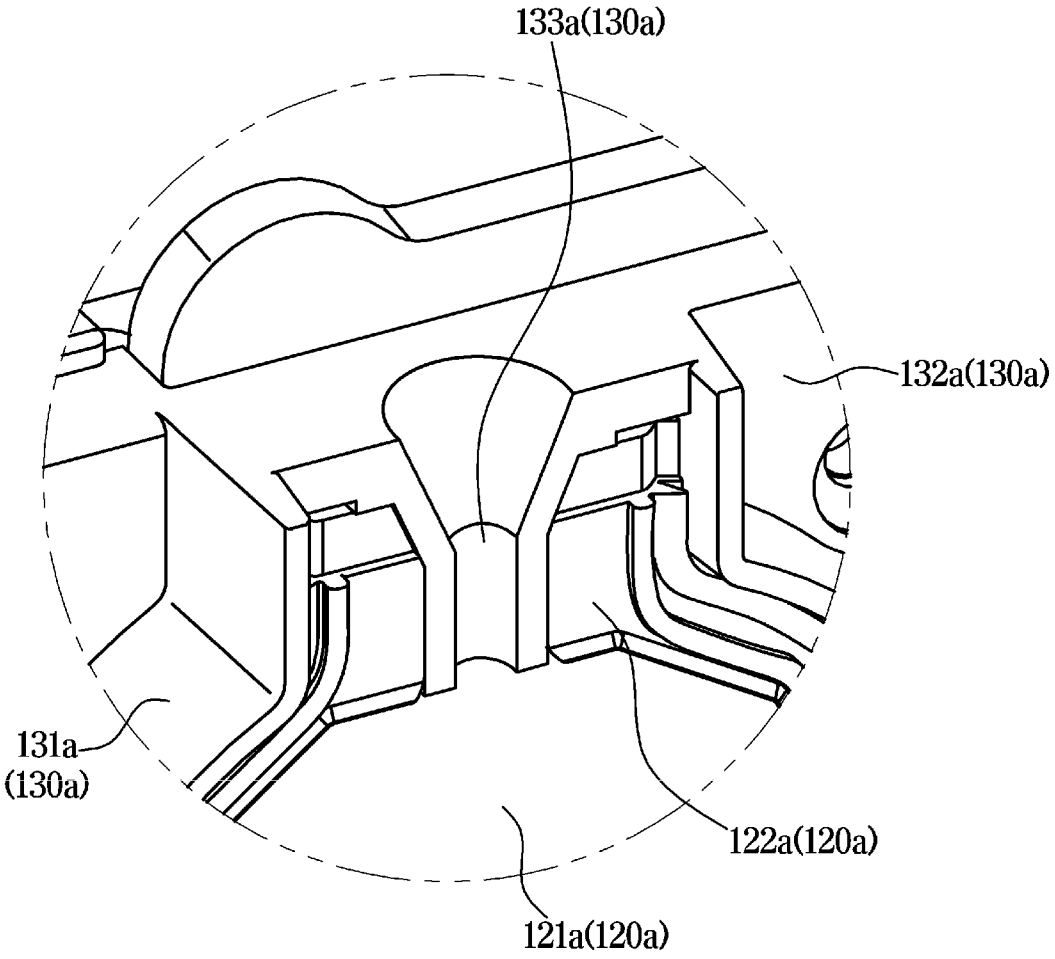
FIG. 18 is an enlarged perspective view of portion G of FIG. 17, according to an embodiment of the disclosure.
Figure 19:
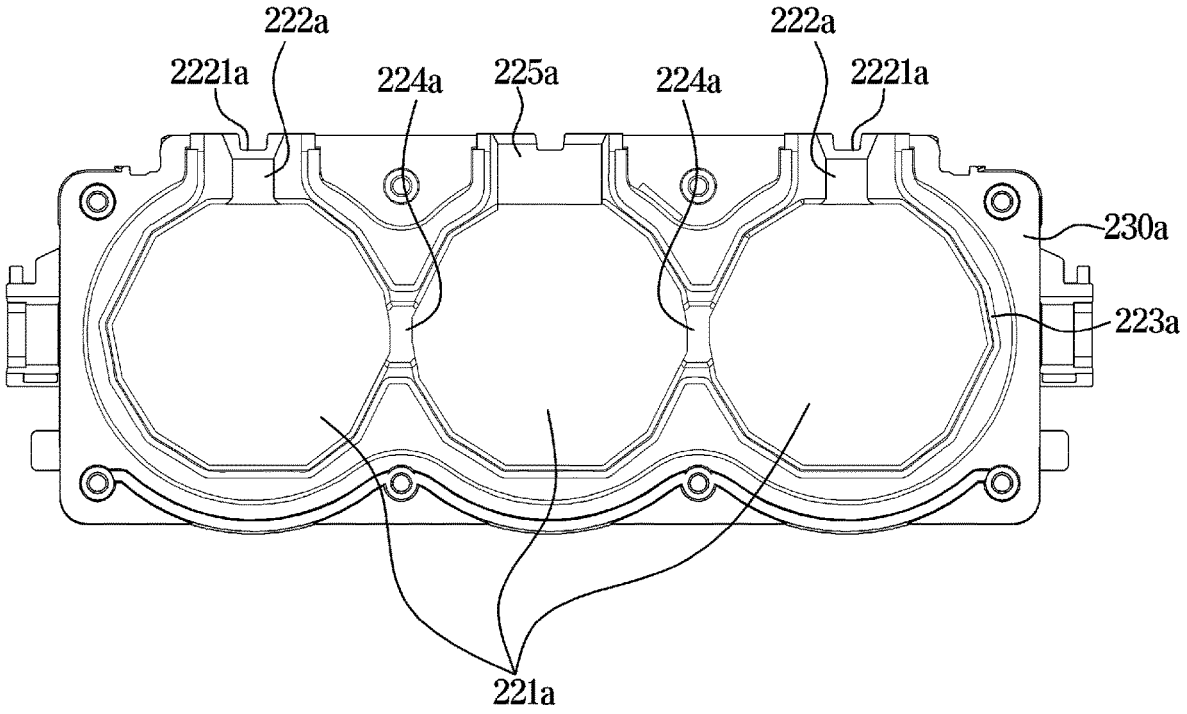
FIG. 19 illustrates a state of a second case, a second tray and a second fixing member shown in FIG. 15 combined, viewed from inside, according to an embodiment of the disclosure.

FIG. 17 illustrates a state of the first case, the first tray and the first fixing member shown in FIG. 15 combined, which is viewed from inside. FIG. 18 is an enlarged perspective view of portion G of FIG. 17. FIG. 19 illustrates a state of the second case, the second tray and the second fixing member shown in FIG. 15 combined, viewed from inside.

Referring to FIGS. 17 and 18, the first auxiliary ice-making cell 122*a* may be sunken inward from the inner surface of the first tray 120*a*.

The first tray 120*a* may include a first sealing portion 123*a*. The first sealing portion 123*a* may be formed to be engaged with the second tray 220*a* to seal the inside of the first main ice-making cell 121*a*, thereby preventing water leakage between the first tray 120*a* and the second tray 220*a*.

The first sealing portion 123*a* may be formed along the boundary of the first main ice-making cell 121*a*.

The first tray 120*a* may include a first inlet 125*a*. The first inlet 125*a* is a portion where the water-supply guide member is received, and the water may be supplied to the first main ice-making cell 121*a* through the first inlet 125*a*.

The first tray 120*a* may include a first connecting portion 124*a*. The first connecting portion 124*a* may be arranged between the plurality of first main ice-making cells 121*a* so that the water flowing into the first main ice-making cell 121*a* connected to the first inlet 125*a* flows to the neighboring first main ice-making cell 121*a*. The first connecting portion 124*a* may be formed by being sunken to the inside of the first tray 120*a*.

As there are three of the first main ice-making cells 121*a* formed in FIG. 17, two of the first connecting portions 124*a* may be arranged. Specifically, water may be supplied to the first main ice-making cell 121*a* at the center through the first inlet 125*a*, and the supplied water may be supplied to the neighboring first main ice-making cells 121*a* on the left and right through the first connecting portions 124*a*.

The first tray 120*a* may include a first blocker 126*a*. The first blocker 126*a* may be formed on the outside of the first sealing portion 123*a*. The first blocker 126*a* may be provided to prevent water filling up the first auxiliary ice-making cell 122*a* from overflowing between the first tray 120*a* and the first fixing member 130*a*. This may facilitate hygiene management of the device because no ice is formed between the first tray 120*a* and the first fixing member 130*a* and no ice fragments are caused.

Unlike the ice maker according to the previous embodiment of the disclosure, the ice maker according to this embodiment of the disclosure may include an auxiliary ice-making cell insert 133*a* extending to the inside of the first auxiliary ice-making cell 122*a*. The auxiliary ice-making cell insert 133*a* may be communicated to the first main ice-making cell 121*a* for the water filling up from the first main ice-making cell 121*a* to be supplied into the auxiliary ice-making cell insert 133*a*. Furthermore, the auxiliary ice-making cell insert 133*a* may be communicated to the storage chamber. In other words, the auxiliary ice-making cell insert 133*a* may be connected to at least one of the plurality of first main ice-making cells 121*a* at one end and opened to the storage chamber at the other end.

This enables water to be supplied to the first main ice-making cell 121*a* through the first inlet 125*a* and simultaneously, enables air to exit to the auxiliary ice-making cell insert 133*a*, thereby keeping the internal pressure constant while forming neatly shaped ice without bubbles.

Furthermore, the ice formed in the auxiliary ice-making cell insert 133*a* may have a narrow cross-sectional area at the bottom. In other words, a portion where the ice formed in the auxiliary ice-making cell insert 133*a* and the ice formed in the first main ice-making cell 121*a* join may have a relatively narrow cross-sectional area. Accordingly, the ice formed in the auxiliary ice-making cell insert 133*a* and the ice formed in the first main ice-making cell 121*a* may be easily separated.

A slope may be formed on the auxiliary ice-making cell insert 133*a* to extend upward at an angle to grow away from the second auxiliary ice-making cell 222*a*.

This may secure a wide space in the auxiliary ice-making cell insert 133*a*. Specifically, with the slope formed on the auxiliary ice-making cell insert 133*a*, oversupplied water may be received in the auxiliary ice-making cell insert 133*a* as much as possible. Accordingly, an amount of the oversupplied water overflowing out of the ice maker may be minimized.

In the ice maker according to this embodiment of the disclosure, ice may be formed in the auxiliary ice-making cell insert 133*a* instead of the first auxiliary ice-making cell 122*a*.

The auxiliary ice-making cell insert 133*a* is a component extending from the first fixing member 130*a* and may be formed of the same material as the first fixing member 130*a*.

For example, the first fixing member 130*a* may be formed of aluminum. It is not, however, limited thereto, and the first fixing member 130*a* may be formed of a material with high thermal conductivity as compared to the second tray 220*a*.

Referring to FIG. 19, the second tray 220*a* may include the second main ice-making cell 221*a* sunken inward from the inner surface, and the second auxiliary ice-making cell 222*a* extending to the top of the second main ice-making cell 221*a*.

Although FIG. 19 shows the three second main ice-making cells 221*a*, the number of the second main ice-making cells 221*a* is not limited thereto. It is enough to have as many second main ice-making cells 221*a* as the number of the first main ice-making cells 121*a*.

The second auxiliary ice-making cell 222*a* may be sunken inward from the inner surface of the second tray 220*a*.

The second tray 220*a* may include a second sealing portion 223*a*. The second sealing portion 223*a* may be formed to be engaged with the first tray 220*a* to seal the inside of the second main ice-making cell 221*a*, thereby preventing water leakage between the first tray 120*a* and the second tray 220*a*.

The second sealing portion 223*a* may be formed along the boundary of the second main ice-making cell 221*a*.

The second tray 220*a* may include a second inlet 225*a*. The second inlet 225*a* is a portion where the water-supply guide member is received, and the water may be supplied to the second main ice-making cell 221*a* through the second inlet 225*a*. The second inlet 225*a* may be formed to face the first inlet 125*a*.

The second tray 220*a* may include a second connecting portion 224*a*. The second connecting portion 224*a* may be arranged between the plurality of second main ice-making cells 221*a* so that the water flowing into the second main ice-making cell 221*a* connected to the second inlet 225*a* flows to the neighboring second main ice-making cell 221*a*. The second connecting portion 224*a* may be formed by being sunken to the inside of the second tray 220*a*.

As there are three of the second main ice-making cells 221*a* formed in FIG. 19, two of the second connecting portions 224*a* may be arranged. Specifically, water may be supplied to the second main ice-making cell 221*a* at the center through the second inlet 225*a*, and the supplied water may be supplied to the neighboring second main ice-making cells 221*a* on the left and right through the second connecting portions 224*a*.

The second tray 220*a* may include a second blocker 226*a*. The second blocker 226*a* may be formed on the outside of the second sealing portion 223*a*. The second blocker 226*a* may be provided to prevent water filling up the second auxiliary ice-making cell 222*a* from overflowing between the second tray 220*a* and the second fixing member 230*a*. This may facilitate hygiene management of the device because no ice is formed between the second tray 220*a* and the second fixing member 230*a* and no ice fragments are caused.

The second auxiliary ice-making cell 222*a* may include a drain groove 2221*a*. Water oversupplied to the second auxiliary ice-making cell 222*a* may flow through the drain groove 2221*a* to and drain through the first drainage 233*a* of the second fixing member 230*a* and the second drainage 215*a* of the second fixing member 230*a*.

The second auxiliary ice-making cell 222*a* may include a second link hole 2222*a* communicated to the second main ice-making cell 221*a*. The second link hole 2222*a* may be formed for the water filling up from the second main ice-making cell 221*a* to be supplied to the second auxiliary ice-making cell 222*a*. Furthermore, the second auxiliary ice-making cell 222*a* may be communicated to the storage chamber. In other words, the second auxiliary ice-making cell 222*a* may be connected to at least one of the plurality of second main ice-making cells 221*a* at one end and opened to the storage chamber at the other end.

This enables water to be supplied to the second main ice-making cell 221*a* through the second inlet 225*a* and simultaneously, enables air to exit to the second auxiliary ice-making cell 222*a*, thereby keeping the internal pressure constant while forming neatly shaped ice without bubbles.

Furthermore, the ice formed in the second auxiliary ice-making cell 222*a* may have a narrow cross-sectional area at the bottom due to the second link hole 2222*a*. In other words, as the second link hole 2222*a* is formed in a small size, a portion where the ice formed in the second auxiliary ice-making cell 222*a* and the ice formed in the second main ice-making cell 221*a* join may have a relatively small cross-sectional area. Accordingly, the ice formed in the second auxiliary ice-making cell 222*a* and the ice formed in the second main ice-making cell 221*a* may be easily separated at the position where the second link hole 2222*a* is formed.

Unlike the ice maker according to the previous embodiment of the disclosure, the ice maker according to this embodiment of the disclosure may form ice between the auxiliary ice-making cell insert 133*a* and the second auxiliary ice-making cell 222*a* by having water oversupplied into a space formed by the first main ice-making cell 121*a* and the second main ice-making cell 221*a* flow between the auxiliary ice-making cell insert 133*a* of the first fixing member 130*a* extending to the inside of the first auxiliary ice-making cell 122*a* and the second auxiliary ice-making cell 222*a*.

In this case, the auxiliary ice-making cell insert 133*a* may be formed of a material having higher thermal conductivity than the second auxiliary ice-making cell 222*a*.

Accordingly, the ice formed in the auxiliary ice-making cell insert 133*a* and the second auxiliary ice-making cell 222*a* is more likely to stick to the auxiliary ice-making cell insert 133*a* when the second tray 220*a* is moved to be separated from the first tray 120*a*.

In other words, as the auxiliary ice-making cell insert 133*a* is formed of a material that has strong adhesive power with ice, the unnecessary part of ice may be stuck to the first tray 120*a* instead of the moving second tray 220*a*.

Figure 20:
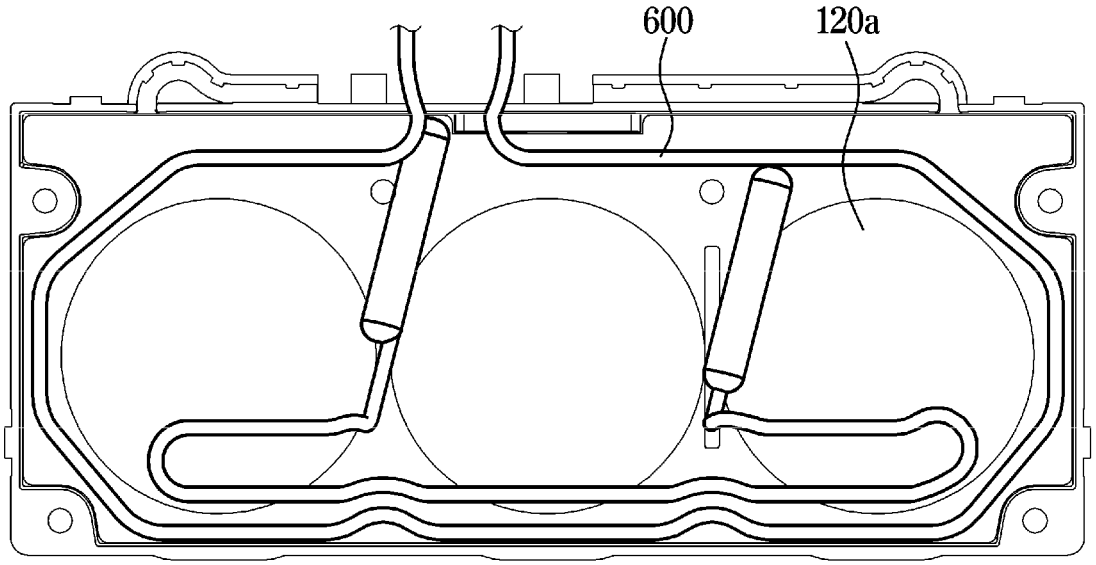
FIG. 20 illustrates a heater arranged on one side of the first tray shown in FIG. 15, according to an embodiment of the disclosure.

FIG. 20 illustrates a heater arranged on one side of the first tray shown in FIG. 15.

As shown in FIG. 20, the heater 600 may be arranged, or positioned, behind the first tray 120*a*. Although not shown, the heater 600 may have a portion supported by the first case 110*a*.

The heater 600 may be provided to heat the first tray 120*a* before the second tray 220*a* is separated from the first tray 120*a*. Hence, the ice formed in the first main ice-making cell 121*a* of the first tray 120*a* may be separated from the first tray 120*a* and moved with the second tray 220*a* while stuck to the second tray 220*a*.

Furthermore, the heater 600 may heat the first tray 120*a* again when the second tray 220*a* is separated from the first tray 120*a* to transfer the ice formed in the first main ice-making cell 121*a* and the second main ice-making cell 221*a* to the ice bucket and then returns to the first tray 120*a*. The heater 600 may be arranged to partially contact the first fixing member 130*a* to apply heat to the first fixing member 130*a*. As the first fixing member 130*a* is formed of a material having high thermal conductivity, ice that remains in the first fixing member 130*a* may be melted even when a very small portion of the first fixing member 130*a* comes into contact with the heater 600.

Hence, the heater 600 may be arranged to melt the unnecessary ice S stuck to the auxiliary ice-making cell insert 133*a* of the first fixing member 130*a* to prevent the ice from remaining in the first tray 120*a* and the second tray 220*a*. This is described in detail herein.

Figure 21:
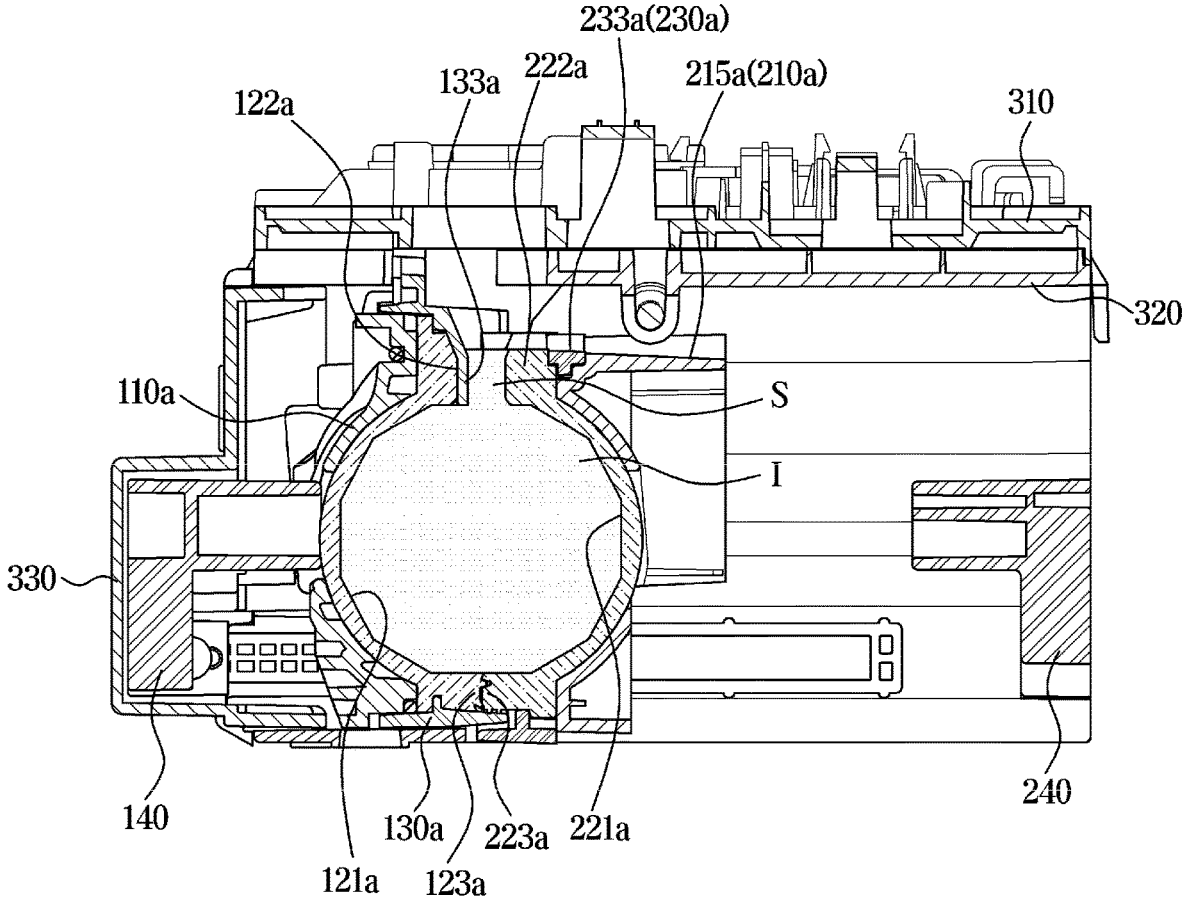
FIGS. 21 and 22 are cross-sectional views of the ice maker along line F-F' of FIG. 15, which illustrate operations of the ice maker, according to an embodiment of the disclosure.
Figure 22:
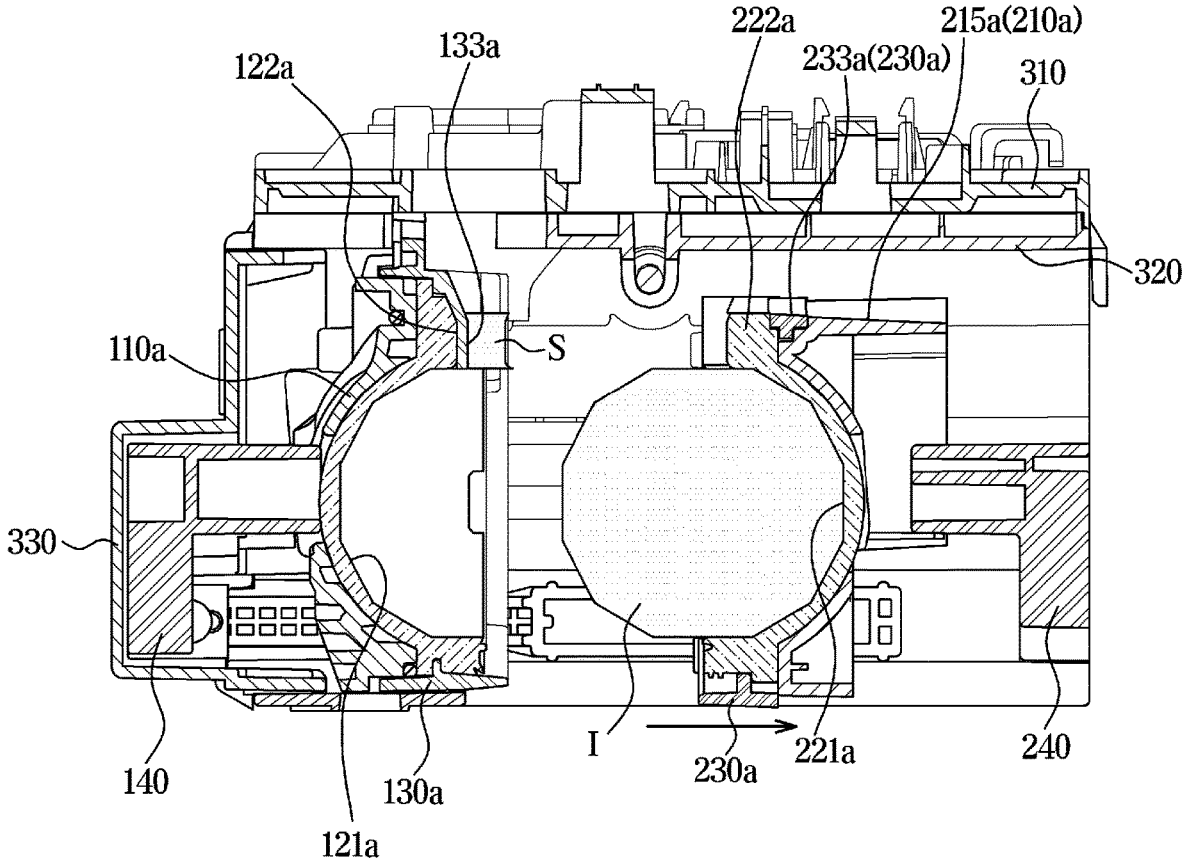

FIGS. 21 and 22 are cross-sectional views of the ice maker along line F-F' of FIG. 15, which illustrate operations of the ice maker.

Referring to FIG. 21, water may be supplied between the first tray 120*a* and the second tray 220*a* to form the ice I in the first main ice-making cell 121*a* and the second main ice-making cell 221*a*.

Furthermore, the unnecessary ice S may be formed on top of the ice I due to oversupplied water. Unlike the ice maker according to the previous embodiment of the disclosure, the ice maker according to this embodiment of the disclosure may form the unnecessary ice S between the auxiliary ice-making cell insert 133*a* and the second auxiliary ice-making cell 222*a* as the auxiliary ice-making cell insert 133*a* extends to the inside of the first auxiliary ice-making cell 122*a*. In other words, a portion of the surface of the ice S may come into contact with the auxiliary ice-making cell insert 133*a*, and some other portions of the surface of the ice S may come into contact with the second auxiliary ice-making cell 222*a*.

Referring to FIG. 22, when the second tray 220*a* is moved away from the first tray 120*a*, the ice I formed in the first main ice-making cell 121*a* and the second main ice-making cell 221*a* is moved along with the second tray 220*a* while stuck to the second main ice-making cell 221*a*. This is because the heater 600 is activated to separate the ice I from the first main ice-making cell 121*a* before the second tray 220*a* is moved, as described above.

On the other hand, the unnecessary ice S formed between the auxiliary ice-making cell insert 133*a* and the second auxiliary ice-making cell 222*a* is stuck to the auxiliary ice-making cell insert 133*a* and separated from the second tray 220*a*. This is because adhesive power between the auxiliary ice-making cell insert 133*a* and the ice S is set to be higher than adhesive power between the second auxiliary ice-making cell 222*a* and the ice S.

Hence, the ice I formed in the first main ice-making cell 121*a* and the second main ice-making cell 221*a* and the ice S formed in the auxiliary ice-making cell insert 133*a* and the second auxiliary ice-making cell 222*a* may be separated.

A subsequent procedure may be performed in the same way as the operations of the ice maker according to the previous embodiment of the disclosure so that the ice I may be completely separated by the second ejector and the first ejector from the first tray 120*a* or the second tray 220*a*.

However, the unnecessary ice S may be still stuck to the auxiliary ice-making cell insert 133*a*. Hence, the second tray 220*a* may return to the first tray 120*a* and the heater 600 may heat the first tray 120*a* while the second tray 220*a* is coupled with the first tray 120*a*. Accordingly, the unnecessary ice S may be melted by the heater 600 and may not remain on the first tray 120*a*.

Figure 23:
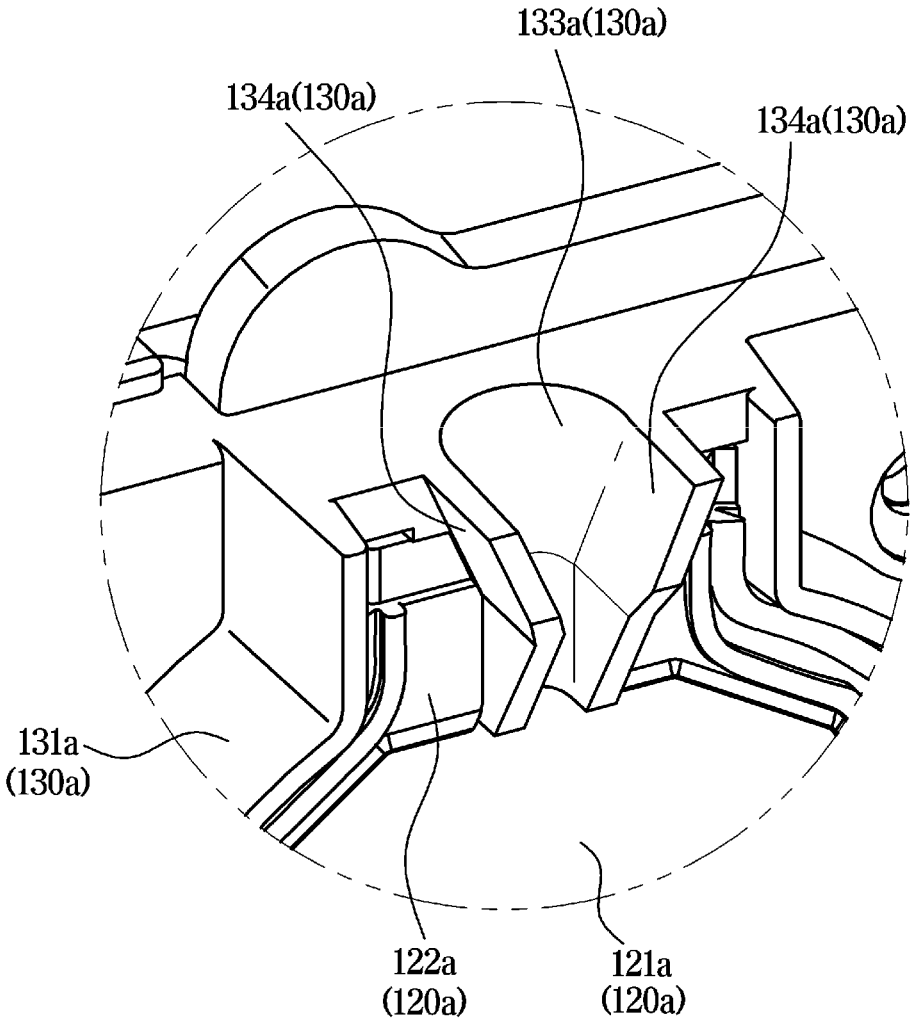
FIG. 23 is an enlarged view of a portion of a first fixing member in an ice maker of a refrigerator, according to another embodiment of the disclosure.

FIG. 23 is an enlarged view of a portion of a first fixing member in an ice maker of a refrigerator, according to another embodiment of the disclosure.

The ice maker of the refrigerator according to this embodiment of the disclosure may include an extension 134*a* unlike the ice maker of the refrigerator according to the previous embodiments of the disclosure.

The extension 134*a* may extend from the first fixing member 130*a* to the second tray 220*a*. The extension 134*a* may extend from the first fixing member 130*a* to the second tray 220*a* and may be received in the second auxiliary ice-making cell 222*a*. That is, the unnecessary ice S may come into contact with the auxiliary ice-making cell insert 133*a* and the extension 134*a*.

This may increase a probability of the unnecessary ice S being stuck to the first tray 120*a* when the second tray 220*a* is separated from the first tray 120*a*.

According to the disclosure, ice formed in the auxiliary ice-making cell is removed from ice formed in the main ice-making cell when the first tray is separated from the second tray, so the ice may give better aesthetic feeling.

Furthermore, more hygienic ice may be formed because the ice separated from the main ice-making cell is not left on the tray.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

What is claimed is:

1. A refrigerator comprising:

a storage chamber; and an ice maker arranged in the storage chamber, the ice maker including:

a support frame;

a pressurizing member arranged on an inner side of the support frame;

a first tray coupleable to the support frame and including a first main ice-making cell and a first auxiliary ice-making cell formed to extend upward from the first main ice-making cell; and a second tray that is moveable, the second tray being coupleable to the support frame, and coupleable to the first tray to form a spherical ice chamber, the second tray including a second main ice-making cell coupleable to the first main ice-making cell to form the spherical ice chamber, and a second auxiliary ice-making cell formed to extend upward from the second main ice-making cell and having a portion that contacts the first auxiliary ice-making cell, and wherein, as the second tray is moved to separate the second main ice-making cell of the second tray coupled to the first main ice-making cell of the first tray that form the spherical ice chamber, the pressurizing member applies pressure to the second auxiliary ice-making cell of the second tray.

2. The refrigerator of claim 1, wherein the second auxiliary ice-making cell comprises:

a projection formed to extend upward to interfere with the pressurizing member as the pressure is applied to the second auxiliary ice-making cell by the pressurizing member.

3. The refrigerator of claim 2, further comprising:

a first case configured to receive the first tray;

a first fixing member configured to cover at least one side among sides of the first tray to couple the first tray to the first case, the first fixing member being coupleable to the first case;

a second case configured to receive the second tray; and a second fixing member configured to cover at least one side among sides of the second tray to couple the second tray to the second case, the second fixing member being coupleable to the second case.

4. The refrigerator of claim 3, wherein the second auxiliary ice-making cell further comprises a drain groove formed in the projection so that oversupplied water flows out of the second auxiliary ice-making cell.

5. The refrigerator of claim 4, wherein:

the second fixing member comprises a first drainage formed at an angle on a top surface so that water drained along the drain groove flows down, and the second case comprises a second drainage formed at an angle on a top surface to be connected to the first drainage.

6. The refrigerator of claim 1, wherein the second auxiliary ice-making cell comprises an extension formed to extend toward the first auxiliary ice-making cell to be received in the first auxiliary ice-making cell.

7. The refrigerator of claim 1, further comprising:

a water supply guide member mountable on the support frame and formed to extend between the first tray and the second tray to guide water supplied from a water supplier to the first main ice-making cell and the second main ice-making cell.

8. The refrigerator of claim 7, wherein:

the first tray comprises a first inlet formed to receive at least a portion of the water supply guide member to allow the water supplied by the water supplier to be introduced into the first main ice-making cell of the first tray, and the second tray comprises a second inlet formed to receive at least another portion of the water supply guide member to allow the water supplied by the water supplier to be introduced into the second main ice-making cell of the second tray, and the second inlet facing the first inlet.

9. The refrigerator of claim 8, wherein:

the first main ice-making cell is among a plurality of first main ice-making cells, the second main ice-making cell is among a plurality of second main ice-making cells, the first tray comprises a first connecting portion formed to be sunken inward between the plurality of first main ice-making cells to allow the water introduced into the first main ice-making cell through the first inlet to flow to a neighboring first main ice-making cell, and the second tray comprises a second connecting portion formed to be sunken inward between the plurality of second main ice-making cells to allow the water introduced into the second main ice-making cell through the second inlet to flow to a neighboring second main ice-making cell.

10. The refrigerator of claim 9, wherein the second auxiliary ice-making cell is connected to at least one of the plurality of second main ice-making cells and connected to the storage chamber.

11. The refrigerator of claim 1, wherein:

the first auxiliary ice-making cell comprises a first slope formed to extend upward at an angle increasing away from the second auxiliary ice-making cell, and the second auxiliary ice-making cell comprises a second slope formed to extend upward at an angle increasing away from the first auxiliary ice-making cell.

12. The refrigerator of claim 11, wherein the first slope is formed to extend at a lower angle than the second slope.

13. The refrigerator of claim 1, further comprising:

a heater behind the first tray to heat the first tray before the second tray is moved.

14. The refrigerator of claim 1, further comprising:

a plurality of transfer gears configured to rotate by receiving power from a motor, each transfer gear among the plurality of transfer gears being arranged on either side of the support frame; and a rack gear interlocked with the plurality of transfer gears to be moved horizontally to move the second tray.

15. The refrigerator of claim 14, wherein the pressurizing member is configured to connect the plurality of transfer gears.

* * * * *